US007431287B2

(12) United States Patent
Hayashi et al.

(10) Patent No.: US 7,431,287 B2
(45) Date of Patent: Oct. 7, 2008

(54) SHEET FEEDING DEVICE, IMAGE-FORMING DEVICE, IMAGE-FORMING SYSTEM, METHOD OF INSTALLING PERIPHERAL DEVICE, AND METHOD OF CONNECTING DEVICES

(75) Inventors: Shigeki Hayashi, Nara (JP); Toshiki Ohgita, Nara (JP); Jinichi Nagata, Osaka (JP); Kiyoshi Tokishige, Kyoto (JP); Naofumi Okada, Tenri (JP); Masaki Saka, Nabari (JP); Toyoaki Nanba, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 365 days.

(21) Appl. No.: 10/558,413

(22) PCT Filed: Feb. 26, 2004

(86) PCT No.: PCT/JP2004/002312

§ 371 (c)(1),
(2), (4) Date: Nov. 28, 2005

(87) PCT Pub. No.: WO2004/109407

PCT Pub. Date: Dec. 16, 2004

(65) Prior Publication Data

US 2006/0239771 A1 Oct. 26, 2006

(30) Foreign Application Priority Data

Jun. 2, 2003 (JP) ..... 2003-156744

(51) Int. Cl.
*B65H 1/00* (2006.01)
*G03G 15/00* (2006.01)

(52) U.S. Cl. ..... 271/162; 271/164; 399/107; 399/110

(58) Field of Classification Search ..... 271/162, 271/164, 287, 298, 145, 198, 201; 399/107, 399/110
See application file for complete search history.

(56) References Cited

U.S. PATENT DOCUMENTS 5,630,578 A 5/1997 Naramore et al.
5,765,825 A 6/1998 Watase

FOREIGN PATENT DOCUMENTS

JP 57-108238 U 7/1982

(Continued)

*Primary Examiner*—Kaitlin S Joerger
(74) *Attorney, Agent, or Firm*—Birch, Stewart, Kolasch & Birch, LLP

(57) ABSTRACT

The subject invention provides a sheet feeding device which can be easily attached to an image forming apparatus. The sheet feeding device includes an adapting part and a lock section. When the sheet feeding device is attached to the image forming apparatus, the adapting part is hooked to a catch section provided in the image forming apparatus. Then, the sheet feeding device is lifted up by the adapting part, which serves as a fulcrum, so as to attach lock section to an attachment board of the image forming apparatus. In this method, it is not necessary to lift up the entire body of the sheet feeding device, and therefore the sheet feeding device can be installed on the image forming apparatus with a little effort. After installation, the sheet feeding device transfers recording sheets to the image forming apparatus via a sheet feeding opening.

21 Claims, 15 Drawing Sheets

FOREIGN PATENT DOCUMENTS

| | | | |
|---|---|---|---|
| JP | 61-2628 | A | 1/1986 |
| JP | 61-173436 | U | 10/1986 |
| JP | 64-4438 | U | 1/1989 |
| JP | 3-88636 | A | 4/1991 |
| JP | 4-125248 | A | 4/1992 |
| JP | 8-245012 | A | 9/1996 |
| JP | 10-35907 | A | 2/1998 |
| JP | 2000-318848 | A | 11/2000 |
| JP | 2003-95453 | A | 4/2003 |

SHEET FEEDING DEVICE, IMAGE-FORMING DEVICE, IMAGE-FORMING SYSTEM, METHOD OF INSTALLING PERIPHERAL DEVICE, AND METHOD OF CONNECTING DEVICES

TECHNICAL FIELD

The present invention relates to a sheet feeding device serving as a peripheral device to be combined with an image forming apparatus; an image forming apparatus; and an image forming system. The present invention further relates to a method of installing a peripheral device, and a method of connecting devices.

BACKGROUND ART

In recent years, there has been suggested an image forming system in which an image forming apparatus is combined with various peripheral devices. One example is an image forming system in which the image forming apparatus is combined with an optional peripheral device on user's demand depending on the circumstances under which the system is used.

For example, by adding a sheet (recording material) feeding device to an image forming apparatus as a peripheral device, it is possible to provide an image forming system capable of easy mass printing. Another example may be an image forming apparatus capable of two-sides printing (surface and rear face of the sheet) in view of resource saving or efficiency of work.

Such combination with a peripheral device improves efficiency of image forming, and therefore the demand of these image forming systems is increasing.

Further, consumption of sheets used for image forming apparatuses or image forming systems is now much larger than ever, and a sheet feeding device (large capacity recording material feeding device), which stores a large amount of sheets and supplies the sheets to an image forming apparatus, is required to have a lot larger capacity.

Japanese unexamined patent publication No. Tokukai 2000-318848 (published on Nov. 21, 2000) discloses an example of sheet feeding device for feeding sheets to an image forming apparatus.

This sheet feeding device is installed on an image forming apparatus by being lifted to be connected to a positioning member of the image forming apparatus.

After combined with the main body of the image forming apparatus, the sheet feeding device is held with the bottom caster untouched with the floor. In this way, the sheet feeding device and the image forming apparatus are combined at a proper position, thus ensuring sheet feeding performance from the sheet feeding device to the image forming apparatus.

More specifically, since positioning of two devices is performed with the sheet feeding device untouched with the floor, the sheet feeding device can be relatively easily brought to a predetermined position, allowing the sheet exit of the sheet feeding device to be met the sheet inlet of the image forming apparatus.

If the positioning of the two devices is performed with the sheet feeding device touched with the floor, inclination and/or irregularities of the floor makes the positioning difficult. Further, even if the positioning succeeded, deformation of the floor with time or the like may cause displacement of combined part of the sheet feeding device and the image forming apparatus. This causes a decrease in sheet transfer efficiency.

However, in the arrangement disclosed in the foregoing publication, the body of the sheet feeding device is not in contact with the floor when combined with the image forming apparatus, and therefore sheet supply can be performed with the both devices combined at a right position.

However, in the arrangement of the foregoing publication, the sheet feeding device has to be lifted completely away from the floor to be combined with the image forming apparatus. This is a certain burden in installation.

More specifically, in the arrangement of the foregoing publication, the sheet feeding device needs to be lifted completely away from the floor when combined with the image forming apparatus, so as to be met the positioning member of the image forming apparatus. However, when the sheet feeding device is large and/or heavy, there is a serious difficulty in lifting or installation of the sheet feeding device.

Further, in the arrangement of the foregoing publication, the positioning member for enabling proper combination of the sheet feeding device and the image forming apparatus at a certain position is provided at the bottom of the sheet feeding device. Therefore, it is difficult to confirm the positioning member at the bottom of the device by user's eyes, making combining the sheet feeding device into the image forming apparatus difficult.

The present invention is made in view of the foregoing conventional problems, and an object is to provide a sheet feeding device allowing easy installation into an image forming apparatus; an image forming apparatus; and an image forming system. The present invention further relates to a method of installing a peripheral device, and a method of easily connecting devices.

DISCLOSURE OF INVENTION

In order to achieve the foregoing objects, a sheet feeding device according to the present invention includes transferring means for transferring sheets from the sheet feeding device to an image forming apparatus on which the sheet feeding device is installed, the sheet feeding device comprising: an adapting part to be operatively connected to a catch section provided in the image forming apparatus; a fitted section to be attached to an fitting section provided in the image forming apparatus, the fitted section being attached to the fitting section by moving the sheet feeding device by a fulcrum formed by connection of the adapting part to the catch section, the sheet feeding device being installed on the image forming apparatus by connection of the adapting part and attachment of the fitted section.

Here, connection of the adapting part to the catch section may be performed with an adapting part having a hole and a hook-type catch section. Or, it may be performed by a catch section having a hole and a hook-type adapting part. Further, the connecting is not limited to this structure, and the shapes of the catch section and the adapting part, and the connecting structure may be modified arbitrarily as long as the adapting part and the catch section, which are connected to each other, can be used as a fulcrum for shifting the sheet feeding device.

Further, the present invention does not restrict the shapes of the fitting section and the fitted section, as long as they are combined with each other to allow the sheet feeding device to be installed on the image forming apparatus. As described, an image forming apparatus on which the foregoing sheet feeding device is installed includes a catch section and an fitting section, and the catch section and the fitting section may have any structures as long as they ensure the following operation of the sheet feeding device.

The adapting part of the sheet feeding device is first connected to the catch section of the image forming apparatus, and the device is shifted by a fulcrum formed by the adapting part and the catch section connected to each other. Then, the fitted section is attached to the fitting section of the image forming apparatus so that the sheet feeding device is installed on the image forming apparatus, allowing the sheet feeding device to supply sheets to the image forming apparatus using the transfer means.

With this structure, it is not necessary to entirely lift up the device when the adapting part is connected to the catch section, or when the fitted section is attached to the fitting section by the adapting part serving as a fulcrum.

More specifically, the adapting part can be connected to the catch section by only inclining the device, as in the example above, instead of lifting up the entire device. That is, the adapting part may be a component to be connected to the catch section of the image forming apparatus by inclining the device. Further, the adapting part may be a bar rotated around an axis, and may be connected to the catch section of the image forming apparatus by its front end As described, the adapting part of the device of the present invention may be expressed as an adapting part, which is connected to the catch section of the image forming apparatus by being shifted by a fulcrum, which is a part of the sheet feeding device. Therefore, the adapting part has a function as a fulcrum when connected to the catch section of the image forming apparatus. With this arrangement, the connecting of the adapting part can be performed without lifting up the entire device.

Further, when the fitting section is attached to the fitted section, the device is shifted by the adapting part serving as a fulcrum, instead of lifting up the entire device.

Thus, the device of the present invention can be installed on the image forming apparatus without lifting up the entire body of the sheet feeding device. On this account, the present invention provides a sheet feeding device easily attached to the image forming apparatus.

Note that, the term "shifting" means not only translational movement but also shifting by rotation. Further, the fulcrum generally means a contact point between an object and another object supporting the object; however, the "contact point" here mainly means a portion of the object at which the object is in contact with another object.

Further, the foregoing image forming apparatus may include a desk device for supporting a device for image forming. In this case, the catch section and the fitting section may be provided in this desk device.

Further, in the foregoing arrangement, each of the adapting part and the fitting section may be constituted of either a single component or plural components. Further, when the adapting part is made up of plural components, the plural adapting parts may be individually connected at the same time, or, they may be connected sequentially, like one of the adapting parts is combined with a corresponding catch section, and followed by another.

Further, the positions for forming the adapting part and the fitting section are not limited. For example, they may be formed on the side at which the device is in contact with the image forming apparatus or on the next side. Otherwise, they may be formed on the bottom or upper surface.

Further, the relation of the adapting part and the fitting section in terms of their position is not limited. For example, it may be arranged so that the adapting part is provided on a lower portion of a side of the device and the fitting section is provided on an upper portion of the same side; on the contrary, the adapting part may be provided on an upper portion and the fitting section may be provided on a lower portion.

Further, when the device is installed on an image forming apparatus at the adapting part and the fitting section, the bottom surface of the device is separated from the floor. Therefore, the device may be combined with the image forming apparatus at a right portion, and their relative position can be fixed to the right position regardless of the deformation of the floor.

Further, the fitting section and the fitted section includes a passive combining section and a combining section, respectively; and the fitting section and the fitted section may be attached by combining the passive combining section with the combining section.

In order to achieve the foregoing object, a sheet feeding device according to the present invention is arranged in addition to the foregoing structure so that: the adapting part is protruding from a body of the sheet feeding device.

With this arrangement, the convex-shape adapting part may be easily connected to the catch section of the image forming apparatus. On this account, the sheet feeding device can be more easily installed on the image forming apparatus.

Note that, the outer face means not only a side of the sheet feeding device but also the bottom face or the upper face.

In order to achieve the foregoing object, the foregoing sheet feeding device further includes: positioning means for determining relative position of the sheet feeding device and the image forming apparatus, the positioning means being provided at a portion close to a sheet discharging section of the transferring means.

With the foregoing structure, the positioning means is provided in the vicinity of the sheet discharging section. On this account, the accuracy of the positioning means is determined according to the desired accuracy in relative positioning of the sheet discharging section and the sheet feeding entrance of the image forming apparatus.

Here, if there is a distance between the sheet discharging section and the positioning means, the positioning means may not sufficiently ensure the desired accuracy in relative positioning of the sheet discharging section and the sheet feeding entrance of the image forming apparatus.

Meanwhile, in the foregoing arrangement, the accuracy in relative positioning of the sheet discharging section and the sheet feeding entrance may be set in a predetermined range according to the distance between the positioning means and the sheet discharging section.

Note that, the structure of the positioning means is not limited. For example, the positioning means may be provided only on the sheet feeding device, or may be provided on both of the sheet feeding device and the image forming apparatus.

Further, the positioning means may be provided on the same lateral side of the main body of the sheet feeding device as that in which the sheet discharging section of the transferring means is formed.

Further, the foregoing sheet feeding device may be arranged so that the adapting part, which holds the weight of the sheet feeding device, and the positioning means are away from each other.

In order to achieve the foregoing object, the foregoing sheet feeding device according to the present invention further includes: a supporting member having a roller member, the supporting member being provided on a bottom of the sheet supplying device on the other side of the adapting part.

With this arrangement, when the adapting part of the sheet feeding device is connected to the catch section of the image forming apparatus, the sheet feeding device can be easily shifted toward the catch section by the roller member of the supporting member. Further, for example, the sheet feeding device may be inclined easily by the roller member of the supporting member serving as a fulcrum. In this way, the adapting part can be connected to the catch section more easily.

Further, since the supporting member is provided on the bottom of the sheet feeding device on the other side of the adapting part, it requires less effort to change the position of the adapting part when the sheet feeding device is lifted up and is rotated about the supporting member to connect the adapting part to the catch section. More specifically, degree in positional change of the adapting part increases even when the same torque is applied to the sheet feeding device. Therefore, positional adjustment becomes easier when the adapting part is connected to the catch section.

Here, it is preferable that the sheet feeding device includes two supporting members. This arrangement offers an effect of easier rotation of the sheet feeding device about an axis vertical to the floor, as well as an effect of reduction in cost for the supporting member. This effect of easier rotation is obtained also when the supporting members are fixed, and only the roller members are rotatable.

However, it is also allowable that the sheet feeding device includes only one supporting member or four supporting members. However, when the sheet feeding device includes four supporting members, the effect of cost reduction cannot be obtained.

Note that, the foregoing structure in which the supporting member is provided on the bottom of the sheet feeding device on the other side of the adapting part may be expressed as a structure in which the supporting member is provided on the bottom of the sheet feeding device on the other side of the image forming apparatus.

In the foregoing structure, the supporting member may be rotatably held by an axis or may be fixed to a certain position. When the supporting member is fixed, it is preferable that the roller member is held by an axis so that it can be shifted to the direction in which the adapting part is provided. With this arrangement, easiness of movement of the sheet feeding device is ensured.

The bottom section of the sheet feeding device may include some areas outside the bottom face, for example, some portion of a lateral side closer to the bottom face.

In order to achieve the foregoing object, the foregoing sheet feeding device according to the present invention further includes: an auxiliary supporting member on the bottom of the sheet feeding device, the auxiliary supporting member having a roller member whose axis is substantially orthogonal to an axis of the roller member of the supporting member.

With this arrangement, it becomes possible to more easily shift the sheet feeding device by rotating it about an axis vertical to the floor when the adapting part of the sheet feeding device is connected to the catch section of the image forming apparatus. More specifically, since the axis of the roller member of the supporting member is substantially orthogonal to the axis of the roller member of the auxiliary supporting member, the sheet feeding device is rotated by pushing the sheet feeding device with the roller member in contact with the floor. On this account, during the translational shifting of the sheet feeding device in parallel to the image forming apparatus to combine the sheet feeding device with the image forming apparatus, it is possible to easily shift (rotate) the sheet feeding device in a direction orthogonal to the moving direction for adjustment.

It is preferable that the sheet feeding device includes one auxiliary supporting member. With this arrangement, only a single auxiliary supporting member and a single supporting member are in contact with the floor, thus easing rotation of the sheet feeding device about an axis vertical to the floor.

Note that, a structure in which each of the supporting member and the auxiliary supporting member is fixed to a certain position and moves only in a certain direction is also preferable. However, the present invention may also be arranged, for example, so that the supporting member and the auxiliary supporting member may be rotatably held by an axis in a certain direction.

Further, the supporting member and the auxiliary supporting member may be arranged so that they are folded after the sheet feeding device is installed on the image forming apparatus, and are unfolded when the sheet feeing device is detached from the image forming apparatus. Further, they may also be arranged so that the supporting member and the auxiliary supporting member are put away inside the sheet feeding device after the sheet feeding device is installed on the image forming apparatus, and come out again when the sheet feeing device is detached from the image forming apparatus.

In order to achieve the foregoing object, the foregoing sheet feeding device according to the present invention further includes: at least two handles, each of which are provided at a different lateral side of the sheet feeding device, one of the handles includes a lifting handle section closer to an end near the adapting part; and each of the handles includes at least one barycentric handle section existing on a same plane as that in which a barycentric vector of the sheet feeding device exists.

With this arrangement, the side having the adapting part of the sheet feeding device can be lifted up by the lifting handle section. As a result, the adapting part can be easily connected to the catch section of the image forming apparatus.

Further, when the sheet feeding device is lifted up to be moved, the user holds the barycentric handle section. As a result, the force of lifting and the gravity for the sheet feeding device become even in the same plane, thus allowing stable shifting of the sheet feeding device. As described, the sheet feeding device of the present invention does not need to be completely lifted up when installed on the image forming apparatus, but can be easily lifted up when shifted to a different position. The barycentric handle section is provided on each of two opposed lateral sides of the sheet feeding device, for example.

Note that, in the foregoing arrangement, both of the following arrangements are allowable as long as the handle(s) includes the foregoing handle sections: 1) one handle is provided on each of the lateral sides; 2) a plurality of handles are provided on each lateral side. The lifting handle section and the barycentric handle section may be provided either on the same plane or different planes.

In order to achieve the foregoing object, an image forming apparatus according to the present invention is an image forming apparatus for carrying out printing on sheets, comprising: a catch section and an fitting section for installing a detachable sheet feeding device that supplies the sheets, the sheet feeding device being connected to the catch section, the sheet feeding device thus connected to the catch section is shifted to be attached to the fitting section, and the image forming apparatus being installed on the sheet feeding device by connection of the adapting part and attachment of the fitting section.

With this arrangement, the present invention realizes the image forming apparatus easily combined with the sheet feeding device of the present invention.

Therefore, with the foregoing sheet feeding device, a sheet feeding device which can be easily installed on the image forming apparatus, and an image forming apparatus capable of easy mass printing are realized.

In order to achieve the foregoing object, the foregoing image forming apparatus according to the present invention further includes: positioning means for determining relative position of the sheet feeding device and the image forming apparatus, the positioning means being provided at a portion close to a sheet feeding entrance through which the sheets are supplied from the sheet feeding device, and being away from the catch section which holds a weight of the sheet feeding device.

With the foregoing structure, the positioning means is provided in the vicinity of the sheet feeding entrance. On this account, the accuracy of the positioning means is determined according to the desired accuracy in relative positioning of the sheet discharging section and the sheet feeding entrance of the image forming apparatus.

Here, if there is a distance between the sheet feeding entrance and the positioning means, the positioning means may not sufficiently ensure the desired accuracy in relative positioning of the sheet discharging section and the sheet feeding entrance of the image forming apparatus.

Meanwhile, in the foregoing arrangement, the accuracy in relative positioning of the sheet discharging section and the sheet feeding entrance may be set in a predetermined range according to the distance between the positioning means and the sheet feeding entrance.

Further, when the sheet feeding device is installed on the image forming apparatus, the weight of the sheet feeding device is supported by the catch section. Therefore, force applied to the positioning means depends on the distance from the catch section.

With this arrangement in which the positioning means and the catch section are away from each other, the force applied to the positioning means is reduced. For example, if the sheet feeding device is horizontally biased with respect to the sheet transfer direction (that is, the sheet feeding device is biased in a direction perpendicular to the sheet transfer direction and parallel to the plane of sheet), the force applied to the positioning means is reduced.

Since this structure prevents deformation or breakage of the positioning means, accurate installation condition is maintained. Further, the sheet feeding means can be lifted up by a smaller force when the sheet feeding means is connected to the image forming apparatus to be installed thereon.

Note that, the structure of the positioning means is not limited. For example, the positioning means may be provided only on the image forming apparatus, or may be provided on both of the sheet feeding device and the image forming apparatus.

Further, the positioning means may be provided on any of the following lateral sides of the image forming apparatus: 1) a side on which the sheet feeding entrance is provided; 2) a side on which the catch section is provided; and 3) a side on which the sheet feeding entrance and the catch section are provided.

In order to achieve the foregoing object, a sheet feeding device according to the present invention is arranged in addition to the foregoing structure so that: the positioning means determines the relative position of the sheet feeding device and the image forming apparatus in a direction perpendicular to a sheet carriage direction and parallel to the sheets to be transferred.

Here, the direction parallel to the plane of sheet and perpendicular to the sheet transfer direction is referred to as a horizontal direction; and the direction vertical to the plane of sheet is referred to as a vertical direction.

With the foregoing arrangement, when the sheet feeding device is connected to the image forming apparatus, wrong positioning of the sheet feeding device in the horizontal direction can be corrected by the positioning means so that the sheet feeding device is properly installed on the image forming apparatus. Further, it is also possible to prevent wrong positioning of the sheet feeding device in the horizontal direction after the sheet feeding device is installed on the image forming apparatus.

Further, wrong positioning in the vertical direction with respect to the sheet transfer direction may be easily corrected by a sheet transfer guide or the like. Therefore, high accuracy is not necessary in the positioning of the sheet feeding device in the vertical direction with respect to the sheet transfer direction.

On the other hand, wrong positioning in the horizontal direction with respect to the sheet transfer direction is hardly correctable by the use of a guide. Thus, for example, it may cause a curve in the plane of sheet, which may be result in failure of sheet transfer. In view of this problem, the foregoing structure securely prevents such wrong positioning of transferred sheets.

Further, the positioning means may be an oval-hole extending in the vertical direction. This oval-hole-type positioning means is so formed as to be combined with a positioning boss or the like, which is another positioning means provided in the sheet feeding device. This arrangement allows positioning of the sheet feeding device in the horizontal direction with respect to the transfer direction. In this way, the positioning may also be performed by an oval-hole-type positioning means in accordance with the oval hole.

In order to achieve the foregoing object, the image forming system according to the present invention comprises one of the foregoing sheet feeding devices and one of the foregoing image forming apparatuses.

More specifically, the image forming system according to the present invention comprises a sheet feeding device including an adapting part and a fitted section; and an image forming apparatus including a catch section and an fitting section. The adapting part and the catch section are connected to each other, and the fitted section of the sheet feeding device is attached to the fitting section of the image forming apparatus by moving the sheet feeding device by a fulcrum formed by connection of the adapting part to the catch section, so that the sheet feeding device is installed on the image forming apparatus by the connection of the adapting part and attachment of the fitted section.

Further, for example, the foregoing image forming system may be arranged so that: each of the image forming apparatus and the sheet feeding device includes positioning means for determining their relative position, the positioning means of the sheet feeding device being provided at a portion close to a sheet discharging section through which the sheets are supplied, and the positioning means of the image forming apparatus being provided at a portion close to a sheet feeding entrance through which the sheets are transferred, and away from the catch section which holds a weight of the sheet feeding device.

In this way, the sheet feeding device can be easily installed on the image forming apparatus, thereby providing an image forming system which deals with mass printing, and is easily upgraded.

In order to achieve the foregoing object, an installation method of a periphery device according to the present invention is a method of installing a periphery device on a main device. The method comprises the steps of: connecting an adapting part of the periphery device to a catch section of the main device; and attaching a fitted section of the periphery device to an fitting section provided in the image forming apparatus, the fitted section being attached to the fitting section by moving the sheet feeding device by a fulcrum formed by connection of the adapting part to the catch section.

Here, in the connection step, the periphery device is inclined by lifting up one end of the bottom with the other end of the bottom in contact with the floor. Then, the periphery device in this state is shifted toward the main device so that the periphery device is connected to the main device.

More specifically, the adapting part can be connected to the catch section of the main device by shifting at least the adapting part by using a part of the periphery device as a fulcrum. The term "connection" here can mean any state in which the adapting part and the catch section are connected to each other, which forms a fulcrum for shifting the periphery device.

With this arrangement in which the periphery device is not entirely lifted up since one end of the bottom, which is the bottom on the opposite side of the adapting part, is supported by the floor, it is possible to distribute the weight of the periphery device. Further, the other end near the adapting part can be easily lifted up by a fulcrum. Therefore, the work for connecting the periphery device to the main device is reduced almost to a half.

Further, in the attachment step for attaching the periphery device to the main device, the periphery device is lifted up at the end opposite to the adapting part while being supported at the adapting part by the main device. Through such connecting step and the attachment step, the periphery device is installed on the main device. In this way, the work for installing the periphery device on the main device is reduced almost to a half.

With this arrangement, the present invention provides a connection method of a periphery device and a main device, which allows easy installation of a periphery device on a main device.

Note that, the main device may be made up of a member serving as a main device, and a periphery device for supporting this member. In this case, the periphery device is installed on the supporting device.

Further, the foregoing method is also expressed as a fabrication method of a periphery device and a main device. The method comprises the steps of: connecting an adapting part of the periphery device to a catch section of the main device; and attaching a fitted section of the periphery device to an fitting section provided in the image forming apparatus, the fitted section being attached to the fitting section by moving the sheet feeding device by a fulcrum formed by the adapting part supported by the catch section.

In order to achieve the foregoing object, an image forming system according to the present invention is an image forming system using the foregoing periphery device installation method for installing a periphery device, the main device of the present invention being an image forming apparatus for carrying out printing on sheets, and the periphery device of the present invention being the sheet feeding device for containing sheets and for supplying the sheets to the image forming apparatus.

More specifically, the image forming system can be upgraded by the installation method for the periphery device.

A recent sheet feeding device has a much larger capacity for sheets than ever, making the device larger and heavier. The sheet feeding device is generally placed on a lower portion of the system.

Generally, it is a lot of work to lift up the sheet feeding device placed on the lower portion of the system. However, in the foregoing installation method for a periphery device, the sheet feeding device is lifted up at the adapting part while being supported at the other end in contact with the floor. In this way, the weight of the sheet feeding device is distributed to the floor, thereby significantly easing the lifting work. Moreover, when the sheet feeding device is installed on the image forming apparatus after the adapting part (one end of the sheet feeding device) is connected to the image forming apparatus, the weight of the sheet feeding device is distributed to the adapting part, thereby reducing the installation work almost to a half.

In order to achieve the foregoing object, an image forming system according to the present invention is an image forming system using a plurality of devices combined one another, comprising: a first device and a second device connected to each other, the first device comprising a catch section and an fitting section which allow installation of the first device to the second device, the second device comprising an adapting part and a fitted section to be attached to the fitting section of the first device, the second device being installed on the first device by connection of the adapting part of the second device to the catch section of the first device and attachment of the fitted section of the second device to the fitting section of the first device.

The image forming system (the system of the present invention) is made up of, for example, a main device from which the recording sheets are discharged and a periphery device to which the discharged recording sheets are supplied. Further, in another case, the image forming system may be made up of a main device, and a periphery device for transferring recording sheets to the main device. Further, in still another case, the image forming system may be made up of a main device and a plurality of periphery devices, such as a first periphery device, a second periphery device etc. One of the main device and the periphery device functions as the first device and the other functions as the second device.

Here, connection of the adapting part to the catch section may be performed with an adapting part having a hole and a hook-type catch section. Or, it may be performed by a catch section having a hole and a hook-type adapting part. Further, the connection is not limited to this structure, and the shapes of the catch section and the adapting part, and the connection structure may be modified arbitrarily as long as the adapting part and the catch section, which are connected to each other, can be used as a fulcrum for shifting the second device.

Further, the present invention does not restrict the shapes of the fitting section and the fitted section, as long as they are combined with each other to allow the second device to be connected to the first device.

In this system, the adapting part of the second device is first connected to the catch section of the first device, and the second device is shifted by a fulcrum formed by the adapting part and the catch section connected to each other. Then, the fitted section of the second device is attached to the fitting section of the first device so that the second device is installed on the first device.

With this structure, it is not necessary to entirely lift up the second device when the adapting part is connected to the catch section, or when the fitted section is attached to the fitting section by the adapting part serving as a fulcrum.

More specifically, the adapting part can be connected to the catch section by only inclining the second device, as in the example above, instead of lifting up the entire body of the second device. That is, the adapting part of the second device may be a component which can be connected to the catch section of the first device by inclining the second device. In this case, the second device is not entirely lifted up as it is supported by the end opposite to the connection end. In this way, the weight of the second device is distributed, and the connection end can be easily lifted up.

With this arrangement, the work for hooking the adapting part of the second device to the catch section, which is provided in another periphery device, a main device or a supporting section of the main device, is reduced almost to a half. Therefore, the adapting part only needs a function as a fulcrum when connected to the catch section. With this arrangement, the connection of the adapting part can be performed without lifting up the entire body of the second device.

Further, when the fitting section is attached to the fitted section, the second device is shifted by the adapting part serving as a fulcrum, instead of lifting up the entire body of the second device.

More specifically, the adapting part of the second device is hooked to the catch section of the first device, and the second device is lifted up at the end opposite to the connection end, while being supported at the other end. In this way, the second device is connected to the first device by the fitting section and the fitted section which function as connecting means.

Thus, it is possible to install the second device on the first device without lifting up the entire body of the second device. Accordingly, the work for connecting the second device to the first device is reduced almost to a half. On this account, the present invention provides an image forming system which allows easy connection between a periphery device and a main device, or between a periphery device and another periphery device.

Note that, the term "shifting" means not only translational movement but also shifting by rotation. Further, the fulcrum generally means a contact point between an object and another object supporting the object; however, the "contact point" here mainly means a portion of the object at which the object is in contact with another object.

Further, in the foregoing arrangement, each of the adapting part and the fitting section may be constituted of either a single component or plural components. Further, when the adapting part is made up of plural components, the plural adapting parts may be individually connected at the same time, or, they may be connected sequentially, like one of the adapting parts is combined with a corresponding catch section, and followed by another.

Further, the positions for forming the adapting part and the fitting section are not limited. For example, they may be formed on the side at which the second device is in contact with the first device or on the next side. Otherwise, they may be formed on the bottom or upper surface. Further, the relation of the adapting part and the fitting section in terms of their position is not limited.

The foregoing image forming system may be expressed as an image forming system for processing (e.g. printing) the sheets transferred thereto with a plurality of devices combined one another, wherein: when the first device is connected to the second device, the connection end of the second device is lifted up with the other end fixed, and the second device is shifted toward the first device so as to hook the adapting part of the second device to the catch section of the first device or of a supporting section of the first device, and then the opposite end to the connection end of the second device is lifted up, so that the second device is connected to the first device or to the supporting section of the first device by the connecting means.

In order to achieve the foregoing object, the foregoing image forming system according to the present invention is arranged so that: the second device includes on a bottom a supporting member having a roller member, the supporting member supporting the second device so that the second device is movable by the supporting member, the supporting member of the second device being not in contact with a floor on which the first device is disposed, when the first device is connected to the second device.

With this arrangement, the second device includes a supporting member, and the second device can be easily shifted by this supporting member.

Further, with this arrangement, the supporting member of the second device is separated from the floor on which the first device is disposed when the first device and the second device are combined. That is, the supporting member and the floor are not in contact with each other. On this account, connection condition between the first and second devices can be kept stable even when the floor is not even or there are some level differences on the floor.

Further, the foregoing image forming system may be expressed as a system in which the second device includes a caster for movably holding the device, the caster being separated from the floor when the second device is installed on the first device.

In order to achieve the foregoing object, the foregoing image forming system according to the present invention is arranged so that: the image forming system includes a main device from which recording sheets are discharged and a plurality of periphery devices from which the recording sheets are supplied, the first and second devices are periphery devices, the main device includes a rail catch section for supporting a rail member, which functions as a track, so that the rail member is movable by the rail catch section, the second device includes a rail fixing section for fixing the rail member, the rail member supported by the rail catch section of the main device is fixed to the rail fixing section of the second device which is connected to the first device, so as to connect the first device and the second device with the main device so that the first device and the second device can be pulled out by the rail member functioning as a track.

With this arrangement, since the second device connected to the first device is connected to the main device by a rail member, which can be pulled out toward, that is, the second device is moved on the rail member, connection/detachment between the first/second devices and the main device becomes easy. On this account, when the recording sheet is caught or jammed between the first/second devices and the main device, these devices can be easily detached/connected, allowing easy recovery.

Further, since the second device is held by a rail member also serving as a track, the second device can be properly connected to the main device.

Further, even though the second device is separated from the floor when the first device is connected to the second device, the second device is supported by a rail member, thereby shifting the second device while keeping it stable.

Further, the foregoing image forming system may be arranged so that the second device includes a catch section for installing another periphery device, the catch section including a rail fixing member.

Further, the foregoing image forming system may be arranged so that the second device includes a fitting section, in addition to the catch section for installing another periphery device. These catch section and the fitting section enable the second device to be connected with any other periphery device having an adapting part and a fitted section.

Note that, the foregoing image forming system may be expressed as a system in which the second device is installed on the first device to form a single unit, which unit is then connected to the main device by connecting the catch section of the second device to the rail member of the main device. In this way, the unit of the first and the second device can be easily and properly connected/disconnected to/from the main device.

In order to achieve the foregoing object, the foregoing image forming system according to the present invention is arranged so that: the first device is a first periphery device provided in a downstream portion in terms of a transfer flow of the recording sheets discharged from the main device, and the second device is a second periphery device provided in an upstream portion than the first periphery device in terms of the transfer flow of the recording sheets so that the second periphery device is more closer to the main device than the first periphery device.

This arrangement allows installation of a periphery device (second periphery device) serving as an intermediate periphery device between another periphery device (first periphery device) on the lowermost portion in the transfer flow and the main device.

Further, the unit formed by combining the first periphery device and the second periphery device can be easily connected/detached to/from the main device.

Note that, the main device may be connected with a plurality of intermediate periphery devices. More specifically, it may be arranged so that the second periphery device is formed by connecting a plurality of periphery devices, and the second periphery device is connected to the first periphery device; then, the combined first and second periphery devices are connected to the main device.

The foregoing image forming system may be expressed as a system in which the first device is a periphery device provided in the lowermost portion in the sheet transfer flow, and the second device is a periphery device provided close to the main device.

In order to achieve the foregoing object, the foregoing image forming system according to the present invention is arranged so that: the first device is a post-processing device, and the second device is either an intermediate transfer device or an inserting device.

The post-processing device designates a device for carrying out various post-processings with respect to the sheets transferred thereto. The post-processing may be, punching, stapling, sorting etc.

Further, the intermediate transfer device designates a device for relaying the sheet to another device.

Further, the inserting device designates a device for interposing a sheet, which is, for example, placed on a tray, among the sheets supplied from other devices, in a desired order and at a desired timing. The inserting device also serves as an intermediate transfer device.

This arrangement allows the intermediate transfer device or the inserting device to be easily moved toward the catch section of the post-processing device when the adapting part of the intermediate device or the inserting device is connected to the catch section. Further, the intermediate transfer device or the inserting device can be easily connected to the post-processing device, thereby unifying these devices.

On this account, the post-processing device and the intermediate/inserting device become a single optional device of the main device, such as an image forming apparatus. Accordingly, those two devices may be connected/disconnected to/from the main device at the same time.

In order to achieve the foregoing object, the foregoing image forming system according to the present invention is arranged so that: the image forming system includes a main device from which recording sheets are discharged and a plurality of periphery devices from which the recording sheets are supplied, the first device is the main device and the second devices is a periphery device.

This arrangement allows the main device, such as an image forming apparatus, to be easily connected with a periphery device which serves as a sheet feeding device.

In order to achieve the foregoing object, the foregoing image forming system according to the present invention is arranged so that: the first device is an image forming apparatus and the second device is a sheet feeding device.

Here, the sheet feeding device is a periphery device separated from the main device, and serves as a large capacity recording material feeding device.

This arrangement allows easy connection between a sheet feeding device and an image forming apparatus.

Further, the foregoing image forming apparatus may include a desk device for supporting a device for image forming. In this case, the catch section and the fitting section may be provided in this desk device.

The foregoing image forming system may be expressed as a system in which the first device is an image forming apparatus, or a desk device for supporting the image forming apparatus; and the second device is a large capacity recording material feeding device.

In order to achieve the foregoing object, a device connecting method according to the present invention is a method for connecting a plurality of devices, the method connecting a first device and a second device with the steps of: connecting an adapting part of the second device to a catch section of the first device; and attaching a fitted section of the second device to an fitting section of the first device by shifting the second device by a fulcrum formed by connection of the adapting part with the catch section.

This device connecting method is used for, for example, an image forming system constituted of a plurality of devices connected to one another. The system includes a first device and a second device connected to one another. More specifically, the system is made up of, for example, a main device from which the recording sheets are discharged and a periphery device to which the discharged recording sheets are supplied. Further, in another case, the image forming system may be made up of a main device, and a periphery device for transferring recording sheets to the main device. Further, in still another case, the image forming system may be made up of a main device and a plurality of periphery devices, such as a first periphery device, a second periphery device etc. One of the main device and the periphery device functions as the first device and the other functions as the second device.

Here, in the connection step, the second device is inclined by lifting up one end of the bottom with the other end of the bottom in contact with the floor. Then, the second device in this state is shifted toward the first device so that the second device is connected to the first device.

More specifically, the adapting part can be connected to the catch section of the first device by shifting at least the adapting part by using a part of the second device as a fulcrum. The term "connection" here can mean any state in which the adapting part and the catch section are connected to each other, thereby forming a fulcrum for shifting the second device.

With this arrangement in which the second device is not entirely lifted up since one end of the bottom, which is the bottom on the opposite side of the adapting part, is supported by the floor, it is possible to distribute the weight of the second device. Further, the other end near the adapting part can be easily lifted up by a fulcrum. Therefore, the work for connecting the second device to the first device is reduced almost to a half.

Further, in the attachment step for attaching the second device to the first device, the second device is lifted up at the end opposite to the adapting part while being supported at the adapting part by the first device. Through such connection step and the attachment step, the second device is installed on the first device. In this way, the work for installing the second device on the first device is reduced almost to a half.

On this account, the present invention provides a device connecting method which allows easy connection between a periphery device and a main device, or between a periphery device and another periphery device.

The foregoing device connecting method may be expressed as a method for connecting a first device and a second device, wherein: when the first device is connected to the second device, the connection end of the second device is lifted up with the other end fixed, and the second device is shifted toward the first device so as to hook the adapting part of the second device to the catch section of the first device or of a supporting section of the first device, and then the opposite end to the connection end of the second device is lifted up, so that the second device is connected to the first device or to a supporting section of the first device by the connecting means.

Additional objects, features, and strengths of the present invention will be made clear by the description below. Further, the advantages of the present invention will be evident from the following explanation in reference to the drawings.

BRIEF DESCRIPTION OF DRAWINGS

FIG. 5(*b*) is a perspective view illustrating a lock boss (fitting section) of the image forming apparatus, and FIG. 5(*c*) is a plan view illustrating a lock section (fitted section) of the sheet feeding device.

FIG. 6(*b*) is another cross sectional view schematically illustrating the sheet feeding device and the image forming apparatus in a different state; and FIG. 6(*c*) is a cross sectional view schematically illustrating a state where the sheet feeding device is connected to the image forming apparatus.

FIG. 14(*b*) is another cross sectional view schematically illustrating the two different peripheral devices in a different state; and FIG. 14(*c*) is a cross sectional view schematically illustrating a state where one of the peripheral devices is connected to the other peripheral device.

BEST MODE FOR CARRYING OUT THE INVENTION

The sheet feeding device according to the present invention serves to store sheets and supply the sheet to an image forming apparatus. The sheet feeding device includes an adapting section and a fitted section by which the sheet feeding device is installed on the image forming apparatus.

The image forming apparatus according to the present invention is an object to which the sheet feeding device is installed by the peripheral device installation method of the present invention. The image forming system according to the present invention includes the image forming apparatus and the sheet feeding device.

Further, in the image forming system of the present invention, the main device, i.e., the image forming apparatus may have other peripheral devices such as post-processing device, an intermediate transfer device, and/or an inserting device. Further, the device connecting method of the present invention may be used for connecting the main device and the peripheral device(s) or for connecting the peripheral devices one another.

First Embodiment

One embodiment of the present invention is described below with reference to FIGS. 1 through 9. The present embodiment describes an image forming system 1 in which a sheet feeding device 3 is installed on a photocopier 2. The sheet feeding device 3 can be easily installed on the photocopier 2.

Figure 2:
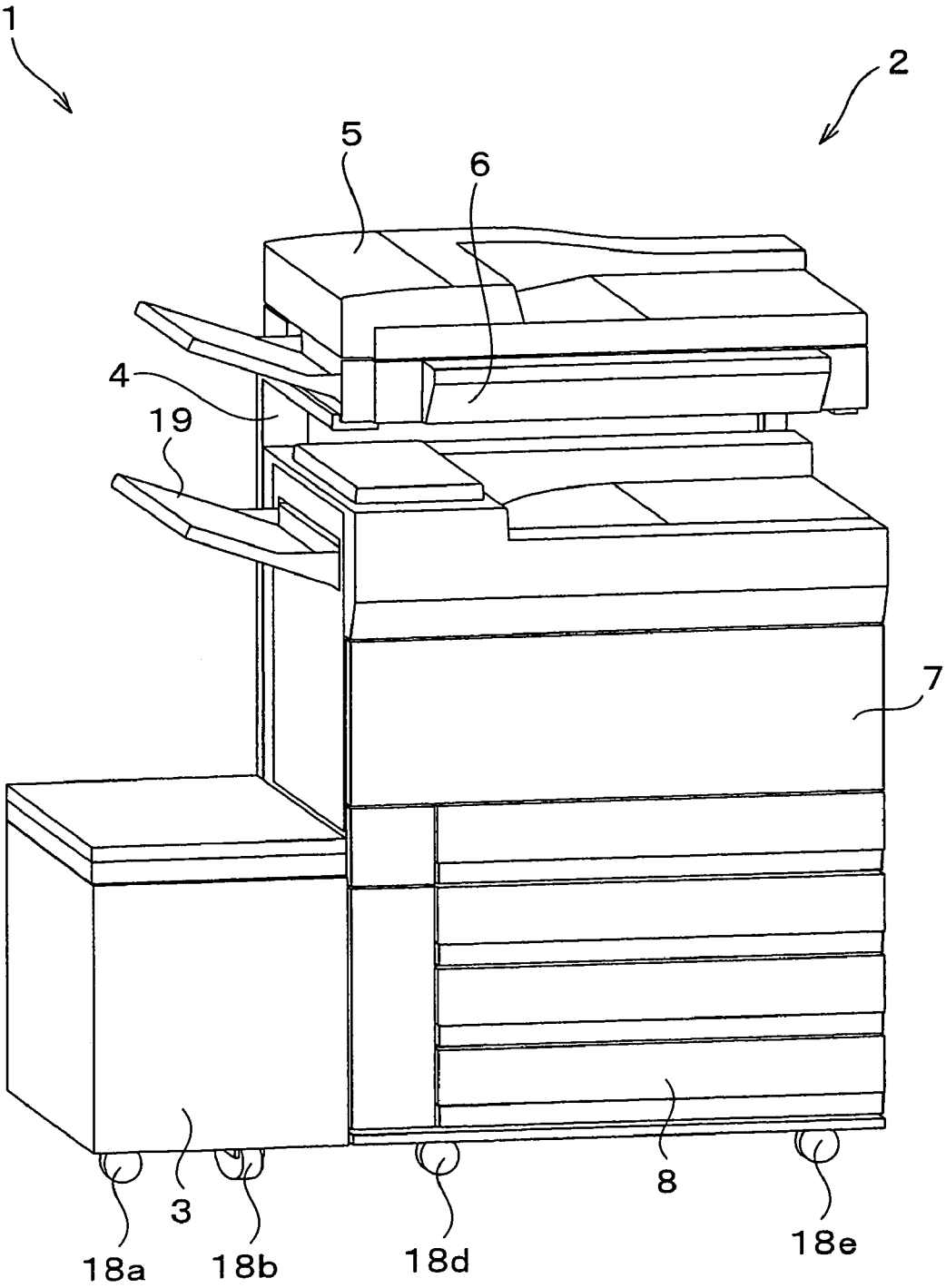
FIG. 2 is a perspective view illustrating an example of image forming system according to the present invention including the foregoing sheet feeding device.

As shown in FIG. 2, the image forming system 1 according to the present embodiment includes the photocopier (image forming apparatus) 2 and a sheet feeding device 3.

The photocopier 2 serves to carry out printing of image information scanned from the document to a sheet (printing sheet, recording material). The photocopier 2 is schematically made up of an automatic document transfer device 5, an image scanning device 6, an image forming section 7 and a sheet supplying device 8.

The automatic document transfer device 5 and the image scanning device 6 are provided above the image forming section 7 and are supported by an image scanning device supporting base 4. The sheet supplying device 8 is provided beneath the image forming section 7.

Meanwhile, the sheet feeding device 3 is provided on a lateral side of the photocopier 2, being attached to the photocopier 2, so as to supply sheets to the image forming section 7 of the photocopier 2. The sheet feeding device 3 is separate from the image forming section 7 or the photocopier 2 and can be attached/detached to/from the photocopier 2.

The automatic document transfer device 5 of the photocopier 2 serves to transfer a sheet document (not shown) to enable the image scanning device 6 to scan the document. The automatic document transfer device 5 sends the sheets one by one to a scanning region (not shown) of the image scanning device 6.

The image scanning device 6 serves to scan an image of a document placed on a predetermined scanning region. The image scanning device 6 may be operated under an automatic scanning mode in which sheet-type documents with images are supplied one by one by the automatic document transfer device 5, and are sequentially exposed to scan the images. Further, the image scanning device 6 may be operated under a manual scanning mode for scanning a book-type document manually supplied, or any other documents which cannot be supplied by the automatic document transfer device 5.

Figure 3:
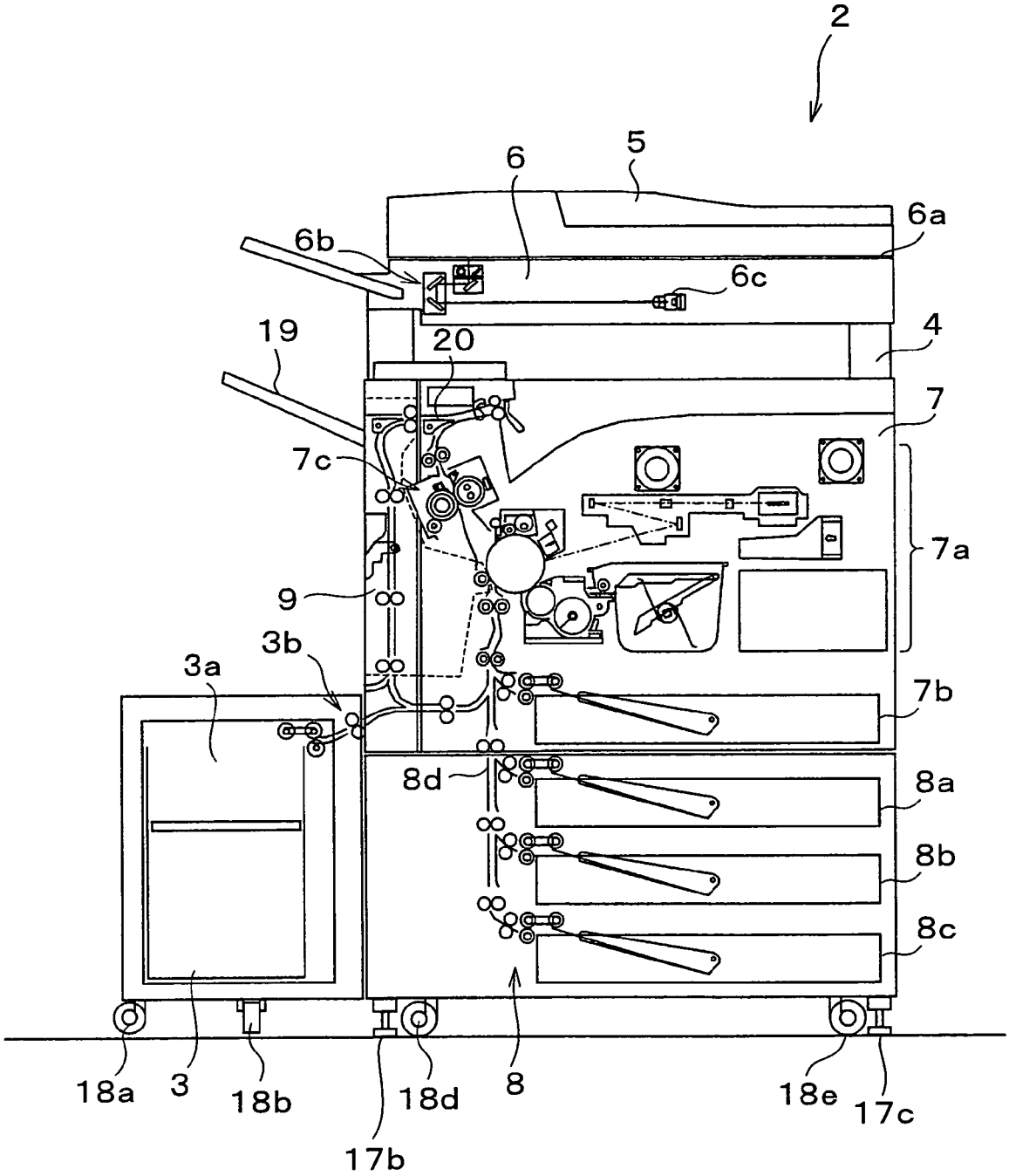
FIG. 3 is a cross-sectional view schematically showing the foregoing image forming system including an example of image forming apparatus according to the present invention.

When the document is scanned, as shown in FIG. 3, the image scanning device 6 exposes the image of the document, which has been transferred to the scanning region of a transparent original platen 6*a*, using a movable scanning optical system 6*b*, thereby scanning the image. The movable scanning optical system 6*b* scans the document by moving under the original platen 6*a* and forms an image on a photoelectric conversion element 6*c*, which is a CCD (Charge Coupled Device). The photoelectric conversion element 6 converts a document image into an electric signal and outputs the signal as image data.

Further, the image scanning device 6 is capable of scanning of both sides of the document. The image scanning device 6 has a function of simultaneous scanning of both sides of document from the bottom and from the top of the document when the automatic document transfer device 5 transfers the document along a document transfer path.

More specifically, in this case, the movable scanning optical system 6*b* sends the optical image to the photoelectric conversion element 6*c* while keeping itself stay still at a predetermined position in the document transfer path, and scans the image on the lower surface of the document.

Further, the upper face of the document is scanned by a contact image sensor (CIS: not shown). The contact image sensor is made mainly of a light source (not shown) for exposing the document, an optical lens for leading the optical image to the photoelectric conversion element, and a photoelectric conversion element for converting the optical image into image data, which are unified as a single device. The contact image sensor is provided on the automatic document transfer device 5.

When the two-sides scanning mode is selected, the documents set in a document supplying section (not shown) of the automatic document transfer device 5 are sequentially transferred, and the both sides of the documents are scanned almost simultaneously by the described structure.

Further, the image forming section 7 of the photocopier 2 carries out printing of supplied image data, which has been scanned by the image scanning device 6, with respect to the sheets. Note that, the image forming section 7 of the photocopier 2 also carries out printing of image data transmitted from an external device (not shown), such as a personal computer.

Figure 4:
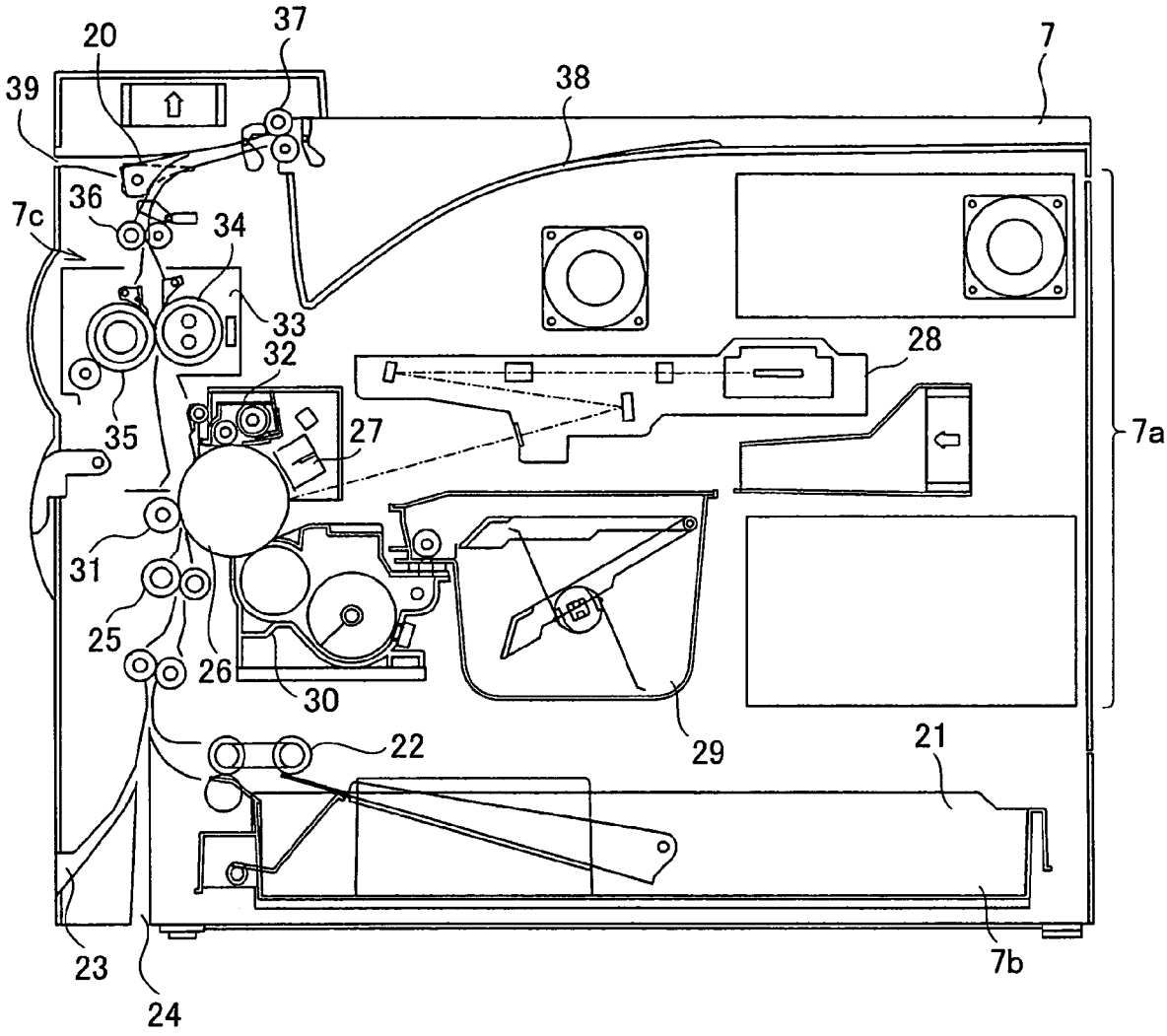
FIG. 4 is a cross sectional view schematically showing a part of the image forming apparatus.

Here, with reference to FIG. 4, the following explains a structure of the image forming section 7 of the photocopier 2. For convenience, FIG. 4 illustrates only the image forming section 7 of the photocopier 2. Further, again for convenience, the internal structure shown in FIG. 4 is slightly different from that of FIG. 3.

The image forming section 7 is schematically made up of a printing section 7*a*, a sheet feeding section 7*b* and a fixing/discharging section 7*c*.

The printing section 7*a* includes a photoconductive drum 26, a laser writing unit 28, a development unit 30 etc. The sheet feeding section 7*b* includes a sheet feeding tray 21. The fixing/discharging section 7*c* includes a fixing device 33, a switching gate 20 etc.

The sheet feeding section 7*b* includes a sheet feeding tray 21 as a recording material containing tray for containing sheets. In addition to the sheets supplied from a sheet device 8 or the sheet feeding device 3, the image forming section 7 also carries out printing with respect to the sheets supplied from the sheet feeding tray 21.

The sheet feeding device 3 supplies sheets through a sheet entrance section 23 via a recording material re-feeding device (described later). The sheet supplying device 8 supplies sheets through a sheet inlet 24. Further, the sheets in the sheet feeding tray 21 are separated from each other by a pickup roller 22 so as to be supplied one by one. The sheet feeding tray 21 is refilled with new sheets by being pulled out toward the front side (operation side) of the photocopier 2.

The photoconductive drum 26 of the printing section 7*a* is evenly charged by a charging device 27. Further, the laser writing unit 28 carries out writing of an electrostatic latent image based on the selected image information onto a uniform charging region of the photoconductive drum 26 which is rotating. Then, the toner supplied from a toner refilling tank 29 is further supplied to the photoconductive drum 26 by a development device 30, so that an electrostatic latent image is developed on the photoconductive drum 26.

Here, a sheet supplied from one of the trays is transferred to the resist roller 25. Then, the sheet is further supplied between transcription section 31 and a photoconductive drum 26 by the resist roller 25 with a precise timing so that the sheet meets the image formed on the photoconductive drum 26.

Then, the image on the photoconductive drum 26 is transcribed onto the sheet. After the image is transcribed, the sheet is sent to the fixing device 33 provided above the image forming section 7. The fixing device 33 sequentially accepts these sheets on which the images are transcribed. Then, the developed image having been transcribed onto the sheet is fixed to the sheet by applying heat and pressure by a fixing roller 34 and a pressure roller 35 of the fixing device 33. In this way, an image is recorded on a sheet.

After subjected to recording, the sheet is carried by a carriage roller 36, and passes through the switching gate 20 where the sheet is separated to be discharged to the recording material re-feeding transfer device (described later) via a discharge opening 39, or to be discharged to a discharge tray 38 via a reverse roller 37.

Note that, the residue toner on the photoconductive roller 26 is removed by the cleaning device 32.

As shown in FIG. 3, the recording material re-feeding transfer device 9 is attached to a lateral side of the image forming section 7. The recording material re-feeding transfer device 9 serves to carry out two-sides printing by reversing the sheet whose one side has already been subjected to printing, so as to carry out printing on the rear side. More specifically, when a sheet whose one side has already been subjected to printing is discharged from the discharge opening 39 of the image forming section 7, the recording material re-feeding transfer device 9 leads the sheet to the reverse roller 37 according to the switching gate 20. Further, the switching gate 20 is switched so that the sheet reversed by the reverse roller 37 is further carried through the discharge opening 39 to the recording material re-feeding transfer device 9. In this way, the sheet is turned over and is lead to the sheet entrance section 23 shown in FIG. 4 by recording material re-feeding transfer device 9. Then the other side of the sheet is subjected to printing in the same manner.

Note that, the structure of the image forming section 7 is only an example, and the present invention may of course use a different printing structure.

The sheet supplying device 8 serves to supply a recording sheet to the image forming section 7. As shown in FIG. 3, the sheet supplying device 8 includes the sheet feeding sections 8*a* through 8*c* and a sheet discharging section 8*d*. The sheet feeding sections 8*a* through 8*c* all contain sheets, respectively.

The sheet supplying device 8 is capable of picking sheets one by one in one of the sheet feeding sections 8*a* through 8*c* selected by the user of the photocopier 2 and sends the sheets to the image forming section 7 via the sheet discharging section 8*d*.

Note that, refilling the sheet feeding sections 8*a* through 8*c* with new sheets, or change of sheets stored in the sheet feeding section 8*a* through 8*c* is performed by respectively pulling out the sheet containing sections 8*a* through 8*c* to the lateral side of the main body of the sheet supplying device 8.

Further, as shown in FIG. 3, the sheet supplying device 8 includes casters 18*d* and 18*e* and height-adjusting leg members 17*b* and 17*c* on the bottom. For convenience, FIG. 3 only illustrates the casters and the height-adjusting leg members in the front of the figure, and other casters and height-adjusting members in the back are not shown.

When the sheet supplying device 8 is shifted, the height-adjusting members 17*b* and 17*c* are shortened, i.e., they less protrude from the bottom of the device than a predetermined degree; in this state, the device is moved by the casters 18*d* and 18*e*. On the other hand, when the sheet supplying device 8 is fixed to a certain position, the height-adjusting members 17*b* and 17*c* are extended, i.e., they protrude from the bottom of the device more than a predetermined degree. Further, the sheet supplying device 8 may be inclined by shortening/extending the respective height-adjusting members 17*b* and 17*c* to different degrees.

In this way, the sheet supplying device 8 also functions as a desk device for supporting the image forming section 7. The sheet supplying device 8 is detachable from the image forming section 7.

Further, in the foregoing example, the sheet supplying device 8 includes three sheet feeding sections 8*a* through 8*c*, but the present invention is not limited to this structure. In other case, the sheet supplying device 8 may include a single sheet feeding section, or of any arbitrary number. Further, the sheet supplying device 8 may include plural sheet discharging sections 8*d* instead of one.

In the present embodiment, the photocopier 2 in which the sheet supplying device 8 is installed on the image forming section 7 functions as an image forming apparatus according to Claims of the present invention. However, an image forming apparatus not containing the sheet supplying device 8 is also included in the range of the present invention. The function of the present invention is ensured when the photocopier constituted of the image forming section 7 includes at least a catch section and a fitting section (both described later).

As shown in FIG. 3, the sheet feeding device 3 according to the present embodiment includes a sheet feeding section 3*a* for containing sheets.

The sheet feeding device 3 supplies sheets stored in the sheet feeding section 3*a* one by one from a sheet outlet (transferring means; shown in FIG. 1) 13 via the sheet discharging section (transferring means) 3*b* to the photocopier 2. The sheets from the sheet feeding device 3 is fed into the image forming section 7 via a sheet feeding entrance provided on a lateral side of the photocopier 2. Note that, the sheet feeding device 3 may include other sheet feeding section than the sheet feeding section 3*a*.

As shown in FIG. 3, the sheet feeding device 3 includes casters 18*a* (supporting member, roller member) and 18*b* (auxiliary supporting member, roller member) on the bottom. For convenience, FIG. 3 omits a caster 18*c* provided on the other side of the caster 18*a*.

The casters 18*a* and 18*c*, which are provided on the bottom of the sheet feeding device 3, are positioned away from the adapting part (not shown) where the sheet feeding device 3 is attached to the photocopier 2. Further, the caster 18*b* has a roller member held by an axis substantially orthogonal to the axis of the roller members of the casters 18*a* and 18*c*. The caster 18*b* is positioned closer to the adapting part than the casters 18*a* and 18*c*.

Further, the casters 18*a* and 18*c*, which are positioned away from the adapting part, allow smooth change in position of adapting part by rotating the sheet feeding device 3 around them when the sheet feeding device 3 is lifted to be connected to the adapting part 3. With this structure, the position of adapting part can be easily adjusted.

Further, since the roller member of the caster 18*b* is held by an axis substantially orthogonal to the axis of the roller members of the casters 18*a* and 18*c*, it allows the adapting part of the sheet feeding device 3 to move orthogonally to the direction of connection when the adapting part of the sheet feeding device 3 is meeting the catch section of the photocopier 2. In this way, the connecting position can be easily changed.

It should be noted that, as shown in FIG. 3, the bottom surface of the sheet feeding device 3 is hung in the air, that is, it is not in contact with the floor, when the sheet feeding device 3 is combined with the photocopier 2. More specifically, when the sheet feeding device 3 is attached to the photocopier 2, the casters 18*a* and 18*b* of the sheet feeding device 3 are separated from the floor, being hung in the air. On this account, the sheet feeding entrance on the lateral side of the photocopier 2 securely meets the sheet discharging section (sheet outlet) of the sheet feeding device 3 even when the flatness of the floor is poor, for example, the floor is bumpy or the like. This ensures reliable sheet carriage performance.

Further, the sheet feeding device 3 has a larger capacity of sheet than the sheet feeding tray 21 of the image forming section 7 of the photocopier 2 or the sheet feeding sections 8*a* through 8*c* of the sheet supplying device 8.

Figure 1:
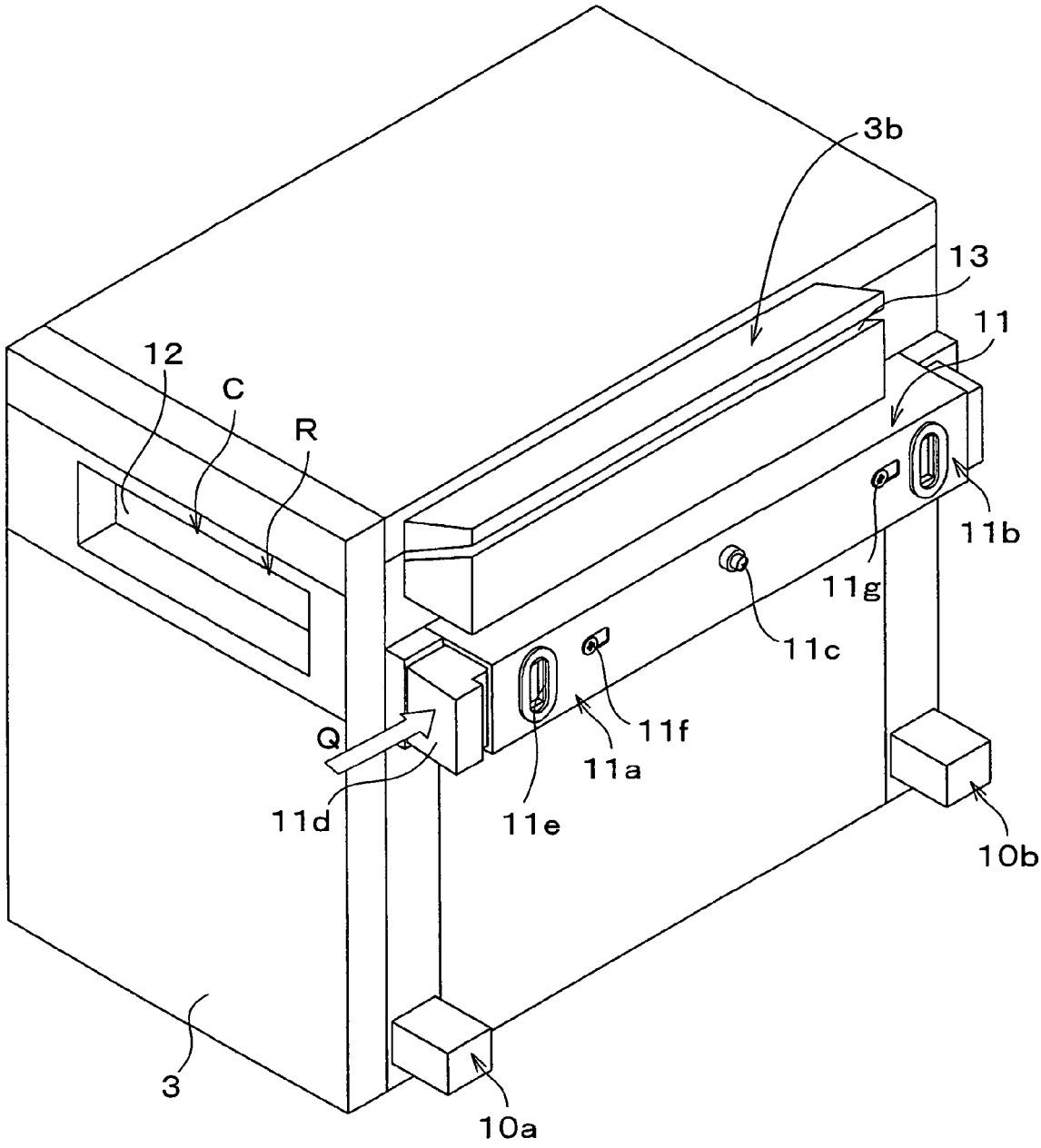
FIG. 1 is a perspective view illustrating an example of sheet feeding device according to the present invention.

Further, as shown in FIG. 1, the sheet feeding device 3 includes adapting parts 10*a* and 10*b*, the connection fixing section 11, and a handle 12.

The adapting parts 10*a* and 10*b* are combined with the catch section of the sheet supplying device 8 of the photocopier 2 to hold the sheet feeding device 3. The adapting parts 10*a* and 10*b* are so formed as to jut out of the sheet feeding device 3 (on a lateral side of the sheet feeding device 3).

The connection fixing section 11 includes lock sections (fitted section) 11*a* and 11*b*, positioning boss (positioning means) 11*c*, a lock release button 11*d*, a lock member 11*e*, and stage bises 11*f* and 11*g*.

By being combined with the lock bosses provided in the sheet supplying device 8, the lock sections 11*a* and 11*b* of the present embodiment enable attachment of the sheet feeding device 3. As described later, the lock bosses are inserted into the lock sections 11*a* and 11*b* and are fixed thereto, so that the sheet feeding device 3 is installed on the photocopier 2.

The positioning boss 11*c* is used for determining the position of the sheet feeding device 3 by being inserted into a positioning hole provided in the sheet supplying device 8. This allows adjustment of the position of the sheet feeding device 3 in the horizontal direction with respect to the sheet carriage direction (in-plane direction of the sheet and perpendicular to the carriage direction). The positioning boss 11*c* is provided close to the sheet discharging section (sheet outlet) 13.

The lock release button 11*d* serves to release the fixation of the lock boss by the lock members 11*a* and 11*b*. When the lock release button 11*d* is pressed in the direction denoted by the allow Q, the lock member 11*e* is moved, and the lock boss is released.

Further, the stage bises 11*f* and 11*g* serve to guide the lock member 11*e*, while restricting its movement within a predetermined range.

The handle 12 is a handle section used for moving the sheet feeding device 3, or for installing the sheet feeding-device 3 into the photocopier 2.

As shown in FIG. 1, the handle 12 of the present embodiment is formed on a lateral side of the sheet feeding device 3, closer to the plane on which the adapting parts 10*a* and 10*b* are formed. The handle 12 is however not limited to this structure as long as it includes a barycentric handle section C and a lifting handle section R (both described later). For example, it may extend from one end to the other of a lateral side of the sheet feeding device 3. Note that, the sheet feeding device 3 of the present embodiment includes another handle (not shown) identically structured to the handle 12 on the other side (rear side) of the plane on which the handle 12 is formed. That is, the sheet feeding device 3 includes a handle on each lateral side.

Note that, the handle on the rear side does not necessarily have to have the same structure as that of the handle 12. For example, the handle 12 and the handle on the rear side may be provided diagonally. In other words, the handle on the rear side may be formed either closer to the side on which the adapting parts 10*a* and 10*b* are formed, or closer to the opposite side.

For example, when the sheet feeding device 3 is lifted to be moved, it is possible to keep a good balance by holding the barycentric handle section C of the handle 12 shown in FIG. 1. The barycentric handle portion C is so constituted that this barycentric handle section C, the barycentric handle section C of another handle on the rear side, and the barycenter of the sheet feeding device 3 exist in the same plane as that in which the barycentric vector of the sheet feeding device 3 exists. This is why the sheet feeding device 3 can be carried with a good balance when the user holds it at the barycentric handle section C.

Meanwhile, when the sheet feeding device 3 is connected/disconnected to/from the photocopier 2, the sheet feeding device 3 may be inclined easily when the user holds around the lifting handle section R of the handle 12. The lifting handle section R is provided closer to the side in which the adapting parts 10*a* and 10*b* are formed. Therefore, by lifting the lifting handle section R, the body of the sheet feeding device 3 may be easily inclined by the casters 18*a* and 18*b*, which function as fulcrums.

Further, in the present embodiment, only one handle 12 is formed on each side of the sheet feeding device 3, but the present invention is not limited to this structure. For example, the handle 12 may instead be two separate handles: a handle on the position of the barycentric handle section C and a handle on the position of the lifting handle section R. That is, each side of the sheet feeding device 3 may have two handles. Further, it is both allowable the rear side has a single handle or two handles.

Figure 5:
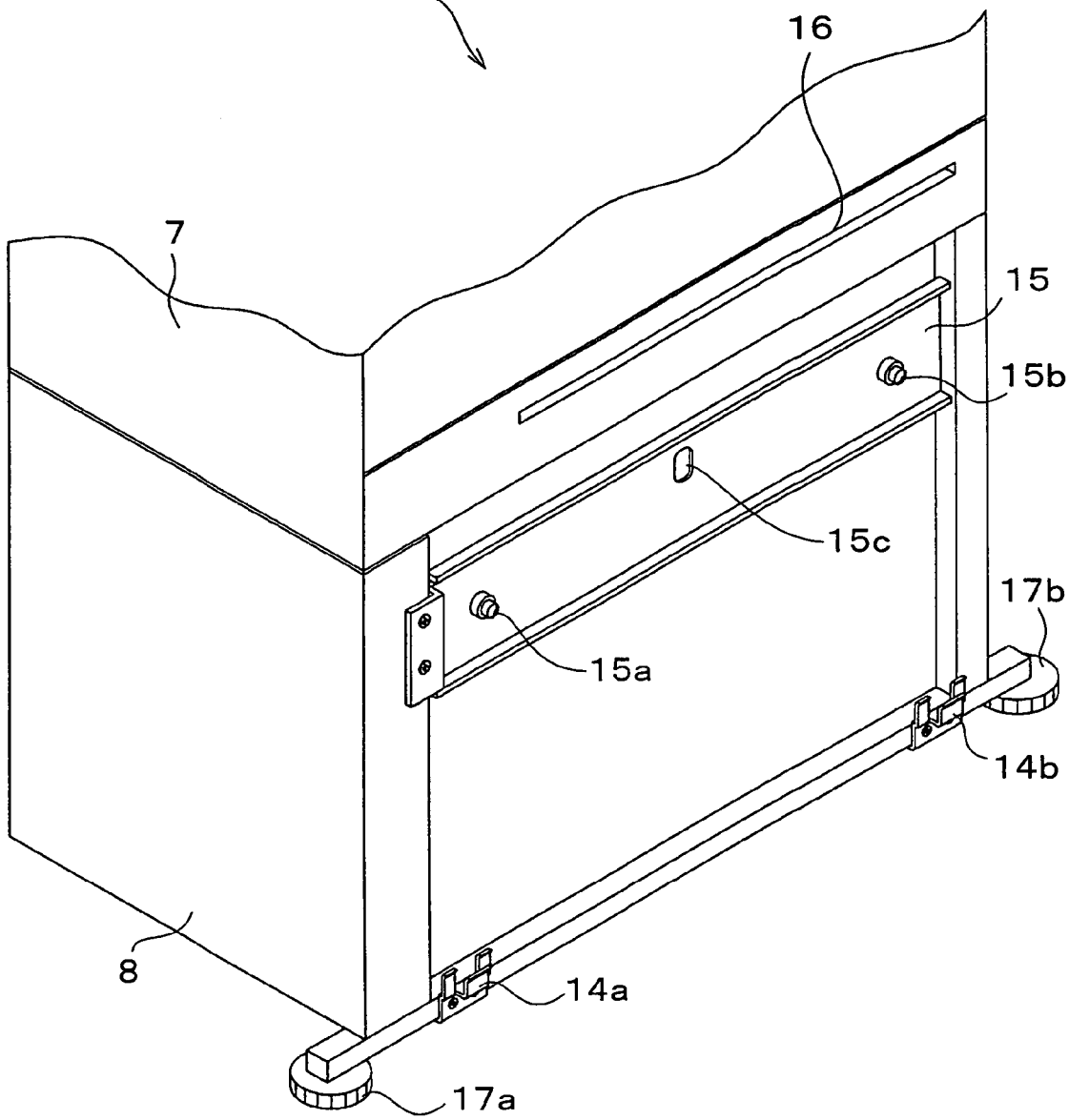
FIG. 5(*a*) is a perspective view illustrating a part of the image forming apparatus.
Figure 5:
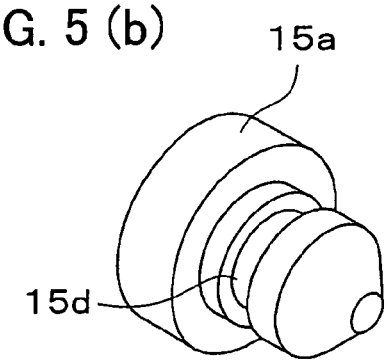
Figure 5:
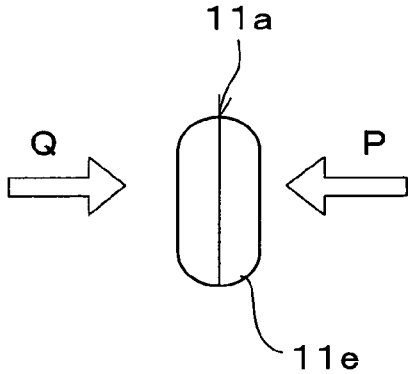

Next, with reference to FIGS. 5(*a*) and 5(*b*), the following explains the structure of the sheet supplying device 8 through which the sheet feeding device 3 is installed on the photocopier 2.

As shown in FIG. 5(*a*), the sheet supplying device 8 includes on a lateral side catch members (catch section) 14*a* and 14*b*, and an attachment plate 15.

The catch members 14*a* and 14*b* are respectively connected to the adapting parts 10*a* and 10*b* of the sheet feeding device 3 so as to hold the weight of the sheet feeding device 3.

The attachment plate 15 includes lock bosses (fitting section) 15*a* and 15*b*, and a positioning hole (positioning means) 15*c*.

The lock bosses 15*a* and 15*b* are respectively inserted into the lock sections 11*b* and 11*a*, and are fixed thereto. Here, as shown in FIG. 5(*b*), the lock boss 15*a* includes a lock groove 15*d*. The lock boss 15*b* includes a similar lock groove.

Meanwhile, as shown in FIG. 5(*c*), the lock section 11*a* of the sheet feeding device 3 includes a lock member 11*e* to which a force is applied in the direction denoted by an arrow P. The lock member 11*e* moves in a range in which the stage bises 11*f* and 11*g* are shifted. The area occupied by the lock member 11*e* in the lock section 11*a* changes as the lock member 11*e* moves.

The lock boss 15*b* is inserted in the vacant space of the lock section 11*a* (the space is shown in FIG. 5(*c*)). The lock member 11*e* of the lock section 11*a* is connected to the lock groove of the lock boss 15*b*. As a result, the lock section 11*a* is attached to the lock boss 15*b*.

The lock member is also provided in the lock section 11*b*. As with the lock section 11*a*, the lock section 11*b* is also attached to the lock boss 15*a* by engaging the lock member with the lock groove 15*d*. Consequently, the sheet feeding device 3 is installed on the photocopier 2.

Detachment of the sheet feeding device 3 from the photocopier 2 can be done by pressing the lock release button 11*d* in the direction denoted by an arrow Q, as shown in FIG. 1. With this operation, the lock member 11*e* moves to the direction of arrow Q in the lock section 11*a* as shown in FIG. 5(*c*), thereby disengaging the lock member 11*e* from the lock groove of the lock boss 15*b*. The lock member of the lock section 11*b* is also moved, and is disconnected from the lock groove 15*d* of the lock boss 15*a*. Consequently, the sheet feeding device 3 is detached from the photocopier 2.

Further, as shown in FIG. 5(*a*), a sheet feeding entrance 16 is provided on a lateral side of the photocopier 2. When the sheet feeding device 3 is installed on the photocopier 2, the sheet discharging section (sheet outlet) 13 of the sheet feeding device 3 and the sheet feeding entrance 16 are connected, allowing sheet transfer from the sheet feeding device 3 to the photocopier 2.

Figure 6:
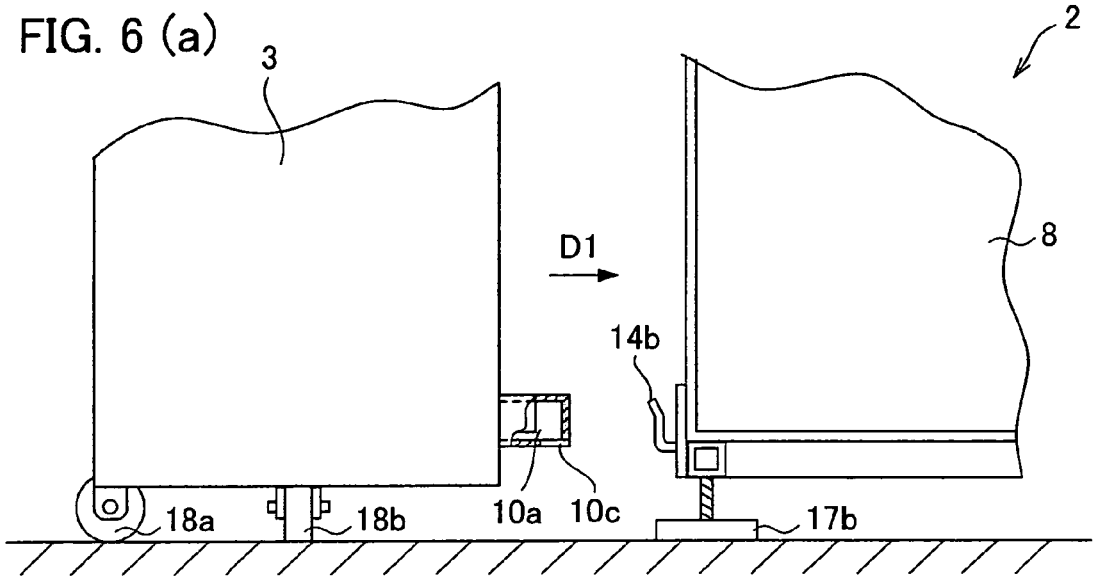
FIG. 6(*a*) is a cross sectional view schematically illustrating the sheet feeding device and the image forming apparatus.
Figure 6:
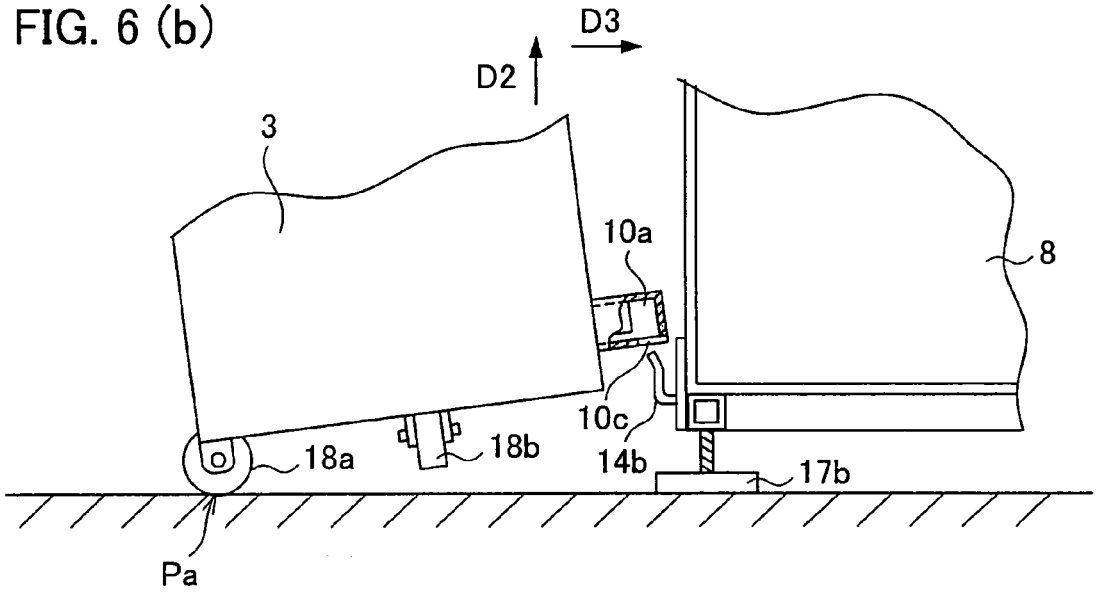
Figure 6:
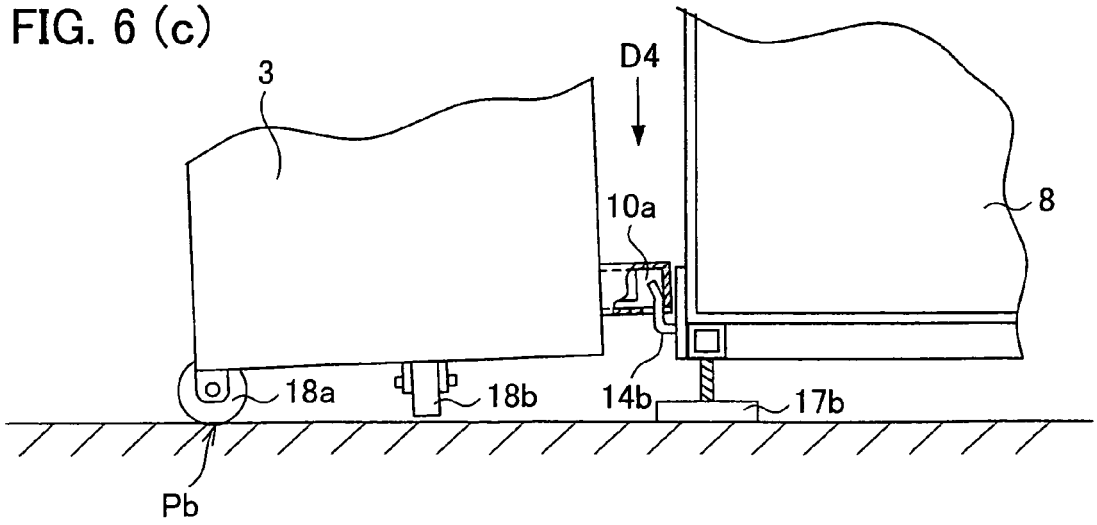
Figure 7:
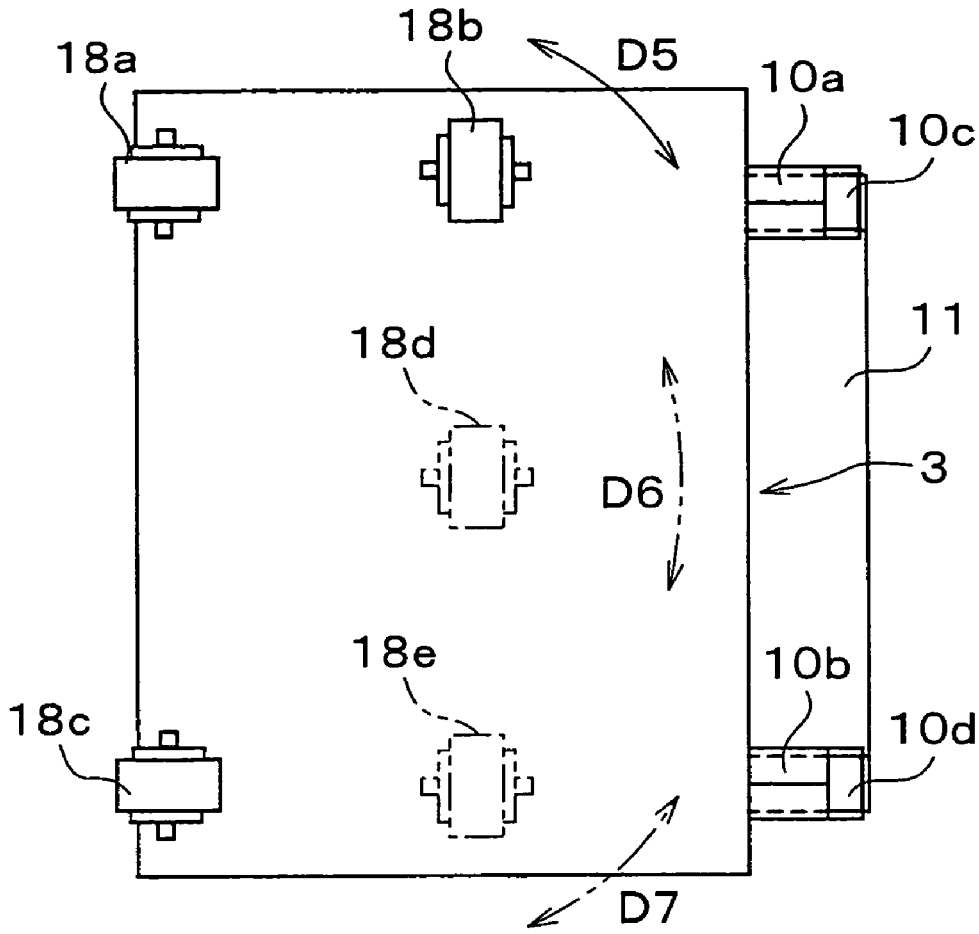
FIG. 7 is a bottom view of the sheet feeding device.
Figure 8:
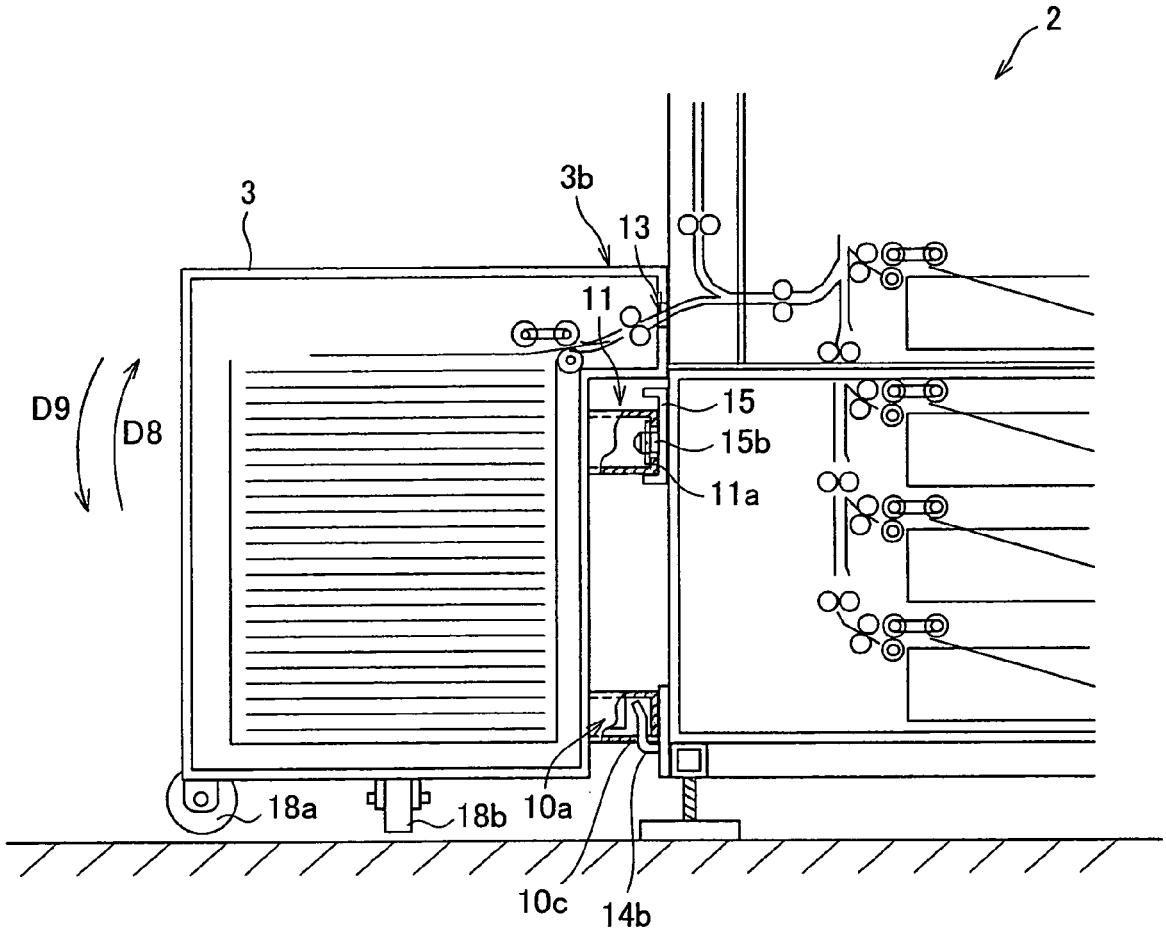
FIG. 8 is a cross sectional view schematically illustrating a state where the sheet feeding device is installed on the image forming apparatus.

Next, with reference to FIGS. 6(*a*) through 6(*c*), and FIGS. 7 and 8, the following explains a step for installing he sheet feeding device 3 into the photocopier 2.

As shown in FIG. 6(*a*), the sheet feeding device 3 is moved in the direction denoted by an arrow D1 by the caster 18*a* etc. toward the photocopier 2, which is fixed to a certain position by the height-adjusting leg member 17*b* or the like. Note that, when the sheet feeding device 3 is lifted to be moved, it is possible to keep a good balance when the user holds the barycentric handle section C of the handle 12 shown in FIG. 1.

Then, as shown in FIG. 6(*b*), the sheet feeding device 3 is lifted in the direction denoted by an arrow D2 by a fulcrum Pa of the caster 18*a* or the like. Here, the sheet feeding device 3 may be lifted easily if the user holds around the lifting handle section R of the handle 12 shown in FIG. 1 for example. The lifted sheet feeding device 3 is moved to the direction denoted by an arrow D3. Due to this movement into the D3 direction, the fulcrum Pb becomes the supporting point of the sheet feeding device 3 as shown in FIG. 6(*c*).

Then, the sheet feeding device 3 is further moved into the direction denoted by an arrow D4 by being supported at the fulcrum Pb. The adapting part 10*a* of the sheet feeding device 3 is connected to the catch member 14*b* of the sheet supplying device 8. Note that, the adapting part 10*b*, which is not shown in FIG. 6(*c*) of the sheet feeding device 3 is also connected to the catch member 14*a*. The connection of the adapting parts 10*a* and 10*b* with the catch member 14*b* and 14*a* may be performed either simultaneously or separately.

Here, as shown in FIG. 7, when the adapting part 10*a* in the state shown in FIG. 6(*c*) is connected to the catch section 14*b* of the sheet supplying device 8, it is possible to easily dispose the adapting part 10*a* at a right place by rotating the sheet feeding device 3 in the direction denoted by an arrow D5 with the casters 18*a*, 18*b* and 18*c*. Here, it is possible to rotate the sheet feeding device 3 in the direction of D5 by lifting only the caster 18*a*, and leaving the casters 18*b* and 18*c* fixed to the ground to hold the sheet feeding device 3.

Further, the adapting parts 10*a* and 10*b* have hook holes 10*c* and 10*d*. As shown in FIG. 6(*c*), the catch member 14*b* is inserted into the hook hole 10*c* so that the catch member 14*b* is operationally connected to the adapting part 10*a*. The hook 10*d* is used in the same way. The insertion of the catch members 14*b* and 14*a* into the hook hole 10*c* and 10*d* becomes easier with larger hook holes.

Note that, the position of the caster 18*b* of the sheet feeding device 3 is not limited to that shown in FIG. 7; for example, it may be provided as the cater 18*d* or 18*e* shown in FIG. 7. In this case, the sheet feeding device 3 can be properly positioned by being rotated in the direction denoted by an arrow D6 or D7.

For example, when the caster 18*b* is replaced with the caster 18*e*, the rotation of the sheet feeding device 3 in the direction D7 becomes easier by lifting the caster 18*c*, and leaving the casters 18*a* and 18*e* fixed to the ground to hold the sheet feeding device 3. Further, when the caster 18*b* is replaced with the caster 18*d*, the sheet feeding device 3 is supported by the casters 18*a*, 18*c* and 18*d*. As the sheet feeding device 3 is most stable in this state, it is most desirable to ensure safety of the sheet feeding device 3 when the sheet feeding device 3 is placed on the floor before being installed on the photocopier 2. However, the rotation in the direction of D6 is a little difficult in this state.

Further, in FIGS. 6(*a*) through 6(*c*), the sheet feeding device 3 is shifted with one of the casters 18*a* through 18*c* in contact with the floor, and therefore it is not necessary to lift up the whole body of the device.

Next, as shown in FIG. 8, with the adapting parts 10*a* and 10*b* completely connected to the catch sections 14*b* and 14*a* of the sheet supplying device 8, the sheet feeding device 3 is lifted up in the direction denoted by an arrow D8 by a fulcrum formed by the adapting parts 10*a* and 10*b*.

As a result, the lock sections 11*a* and 11*b* are connected to the lock bosses 15*b* and 15*a* of the sheet supplying device 8.

In this case, the sheet feeding device 3 is positioned at a certain place by inserting the positioning boss 11*c* into the positioning hole 15*c*.

In the foregoing structure of FIG. 8, the sheet feeding device 3 is lifted by the fulcrum formed by the adapting parts 10*a* and 10*b*, and therefore it is not necessary to lift up the whole body of the device.

Further, in the sheet feeding device 3 attached to the photocopier 2, the casters 18*a* through 18*c* on the bottom are not in contact with the floor, as shown in FIG. 8. Thus, the sheet feeding device 3 can be installed on the right position, and will be fixed thereto.

The sheet feeding entrance 16 of the photocopier 2, which is shown in FIG. 5, is formed oppositely to the sheet discharging section (sheet outlet) 13 of the sheet feeding device 3. Further, as shown in FIG. 1, the sheet discharging section (sheet outlet) 13 is provided right above the positioning boss 1*c* of the connection fixing section 11.

When the sheet feeding device 3 is installed on the photocopier 2 in the foregoing manner, the adapting parts 10*a* and 10*b* of the sheet feeding device 3 are connected to the catch sections 14*b* and 14*a* of the photocopier 2 first, and then the sheet feeding device 3 in fixed to a certain position by the positioning boss 1*c* and the positioning hole 15*c*. In this case, the relative position of the sheet discharging section (sheet outlet) 13 and the sheet feeding entrance 16 is easily recognized, making the positioning more accurate. Further, the accuracy of positioning by the positioning boss 11*c* and the positioning hole 15*c* can be adjusted according to the desired accuracy of positioning of the sheet outlet 13 and the sheet feeding entrance 16.

By thus installing the sheet feeding device 3, the photocopier 2 becomes capable of mass printing with the sheets supplied from the sheet feeding device 3.

When the sheet feeding device 3 is detached from the photocopier 2, the lock sections 11*a* and 11*b* are disconnected from the lock bosses 15*b* and 15*a* in response to pressing of lock release button 11*d* so that the sheet feeding device 3 moves in the direction denoted by an arrow D9 in FIG. 8. Then, the process shown in FIGS. 6(*a*) through 6(*c*) is carried out in the reverse order, and the sheet feeding device 3 is detached from the photocopier 2.

As described, the present invention relates to an image recording system having a great scalability. In this system, any image recording device with an arbitrary function, such as a photocopier, a printer etc., can be connected to an arbitrary peripheral device.

The sheet feeding device according to the present embodiment includes the adapting parts 10*a* and 10*b* and the lock sections 11*a* and 11*b*. The sheet feeding device 3 is installed on the photocopier 2 by connection of the adapting parts 10*a* and 10*b* and attachment of the lock sections 11*a* and 11*b*. The photocopier 2 according to the present embodiment is an image forming apparatus to which the sheet feeding device 3 is installed. Further, the image forming system 1 according to the present embodiment includes the photocopier 2 and the sheet feeding device 3.

Further, as described, the periphery device installation method according to the present embodiment includes a step (FIGS. 6(*a*) through 6(*c*)) of connecting the adapting parts 10*a* and 10*b* of the sheet feeding device 3 serving as a periphery device into the catch members 14*a* and 14*b* of the photocopier 2 serving as the main device; and a step (FIG. 8) of attaching the lock sections 11*a* and 11*b* of the sheet feeding device 3 into the lock bosses 15*b* and 15*a* of an attachment plate 15 of the photocopier 2 by a fulcrum formed by the adapting parts 10*a* and 10*b*, which are supported by the catch members 14*a* and 14*b*, as the supporting point. In this manner, the sheet feeding device 3 is installed on the photocopier 2.

With this method, the present invention provides the sheet feeding device 3 which can be easily installed on the photocopier 2. Further, the foregoing method also provides a photocopier 2 to which the sheet feeding device 2 is easily attached. The present invention also provides, with the foregoing method, an image forming system 1 allowing easy installation of the sheet feeding device 3 as a periphery device to upgrade the system. Further, the present invention also provides a method for installing a periphery device to the main device of the system.

Further, as described, the lock section 11*a* serving as a fitted section of the present embodiment includes a lock member 11*e*. Further, the lock boss 15*b* serving as a fitting section includes a lock groove. The lock member 11*e* is pressed into a predetermined direction, which is perpendicular to the attachment direction, and then is fitted into the lock groove, thereby connecting the fitted section to the fitting section. On the contrary, the lock section 11*e* is pressed into a direction opposite to the foregoing predetermined direction by the lock release button 11*d*, so that the fitted section is disconnected from the fitting section.

The foregoing structure may be alternatively expressed such that the fitted section and the fitting section respectively include the lock member 11*e* serving as a combining section and the lock groove serving as a passive combining section, and the combining section is combined with the passive combining section so that the fitted section is attached to the fitting section. Further, the foregoing structure may be expressed such that the lock release button 11*d* is provided as a detachment switch which moves the combining section in a direction perpendicular to the combining direction so that the passive combining section is disconnected from the combining section, thereby detaching the fitting section from the fitted section.

These arrangements significantly simplify installation and disinstallation of the sheet feeding device 3.

Note that, in this example, the fitted section includes the combining section, while the fitting section includes the passive combining section; however, the present invention is not limited to this, and may be arranged so that the fitted section includes the passive combining section, while the fitting section includes the combining section.

Figure 9:
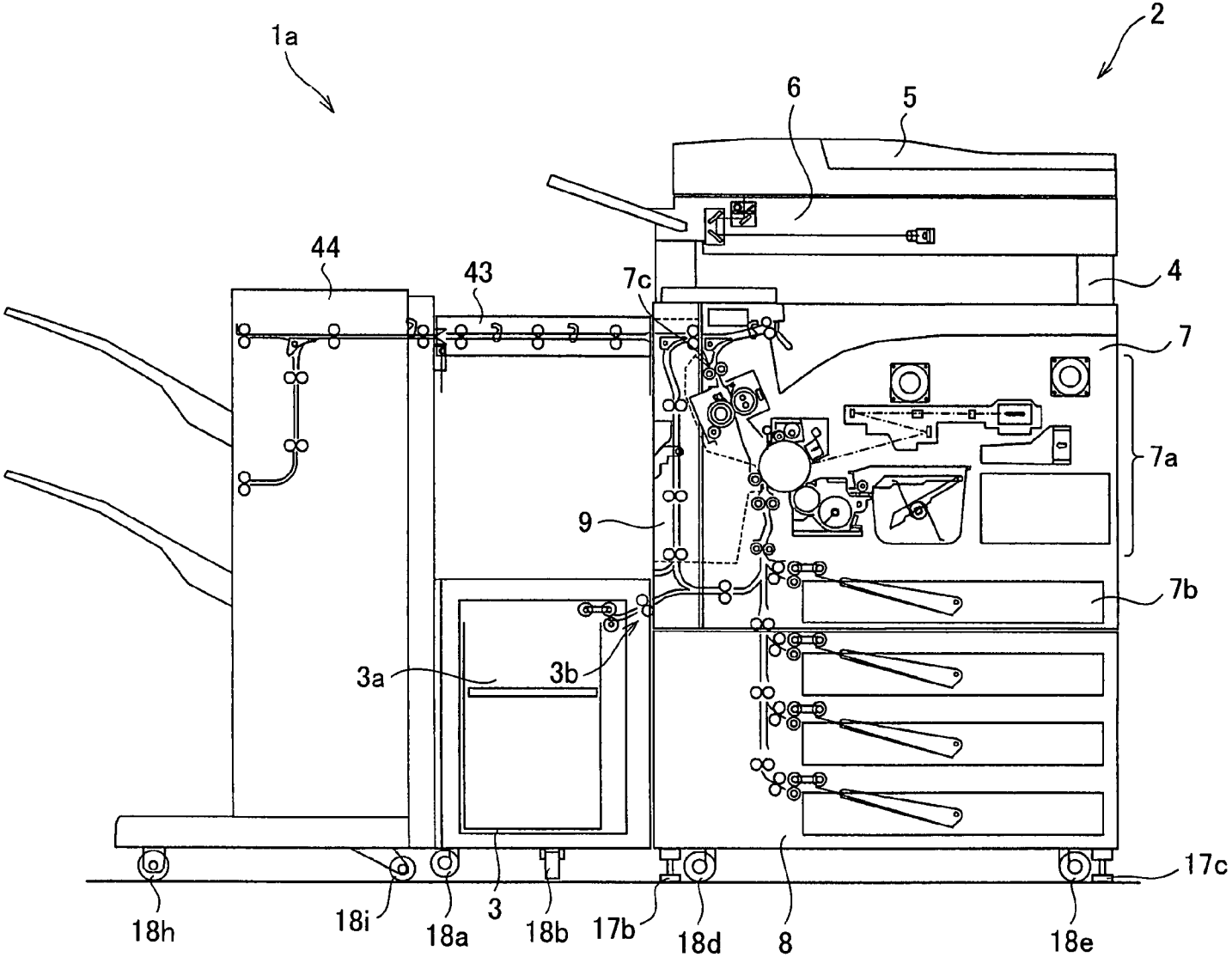
FIG. 9 is a cross sectional view schematically illustrating a modification of the image forming system.

It should be noted that the present invention is not limited the structures described above. For example, as shown in FIG. 9, the image forming system 1*a* may include an intermediate transfer device 43 and a post-processing device 44. More specifically, the image forming system 1*a* may include the intermediate transfer device 43 and the post-processing 44 instead of the sheet discharging tray 19 shown in FIG. 3. The intermediate transfer device 44 includes casters 18*h* and 18*j*, allowing easy movement.

Further, the present invention is not limited to the rectangular parallelepiped sheet feeding device 3 shown in FIG. 1. The sheet feeding device 3 may have a different shape.

Second Embodiment

Another embodiment of the present invention is described below with reference to FIGS. 10 through 15. The present embodiment describes an image forming system 51 which includes an inserter 54 and a finisher 55, in addition to a feeding device 53 and a photocopier 52.

Figure 10:
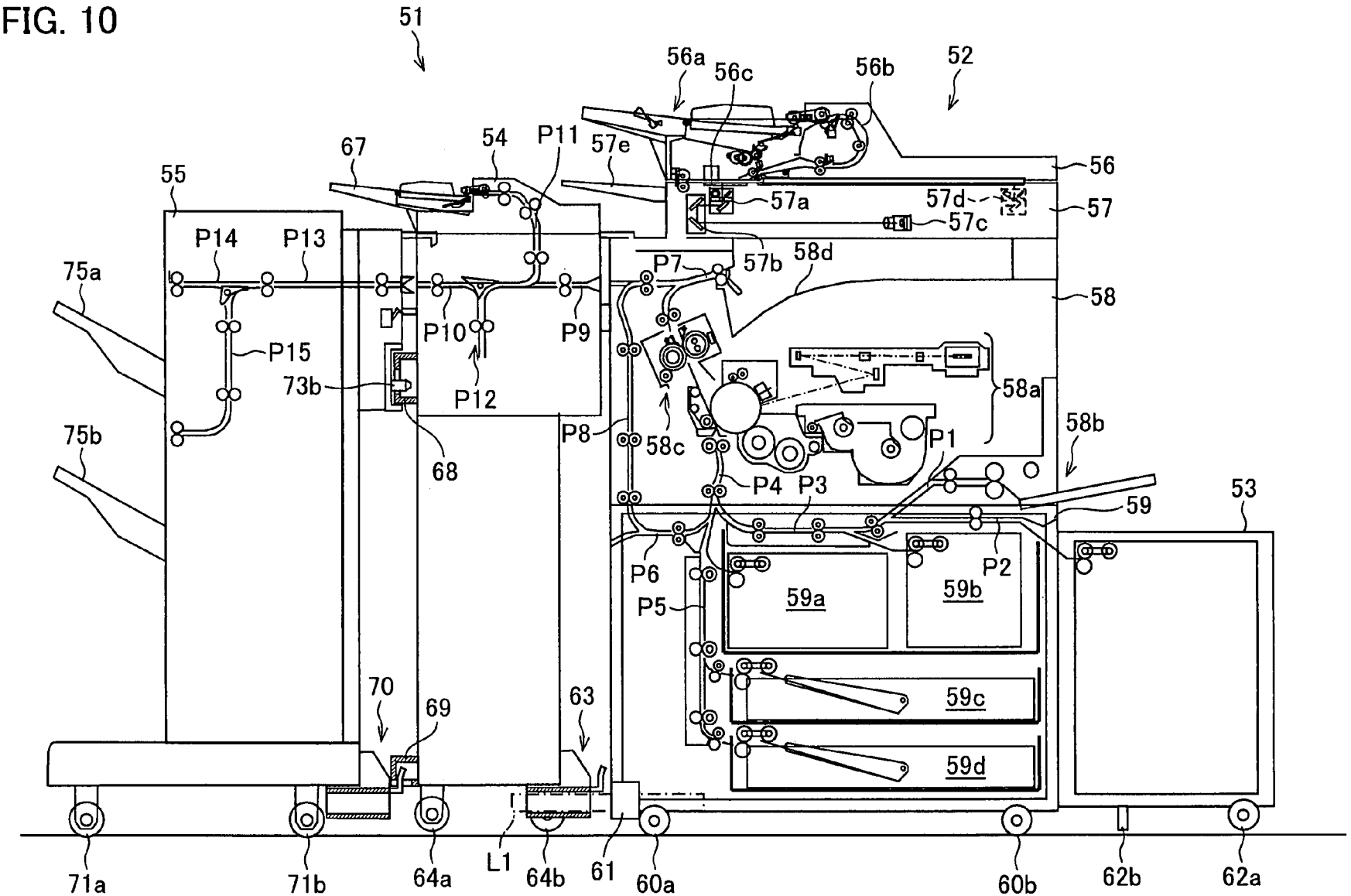
FIG. 10 is a cross sectional view illustrating an image forming system according to another embodiment of the present invention.

As shown in FIG. 10, the image forming system 51 of the present embodiment includes the photocopier (image forming apparatus, main device, first device) 52, the sheet feeding device (periphery device, second device) 53, the inserter (inserting device, second device, second periphery device) 54 and the finisher (post-processing device, first device, first periphery device) 55.

The photocopier 52 serves to print the image information onto a sheet (printing sheet, recording material). The photocopier 52 has the same function as that of the photocopier 2 of First Embodiment above. The photocopier 52 is schematically made up of an automatic document transfer device 56, an image scanning device 57, an image forming section 58 and a sheet supplying device 59.

The automatic document transfer device 56 and the image scanning device 57 are provided above the image forming section 58. The sheet supplying device 59 is provided beneath the image forming section 58.

Meanwhile, the sheet feeding device 53 is provided on a lateral side of the photocopier 52, being attached to the photocopier 52, so as to supply sheets to the image forming section 58 of the photocopier 52. The sheet feeding device 53 is separate from the image forming section 58 or the photocopier 52 and can be attached/detached to/from the photocopier 52.

The inserter 54 serves as an inserting device for interposing any other arbitrary sheet not stored in the photocopier 52. Here, for example, when a specific sheet is supplied from the photocopier 52, the sheet needs to pass through the image forming section 58 even when it is not necessary. However, with the inserter 54, any arbitrary sheet can be directly inserted without passing through the image forming section 58.

The inserter 54 of the present embodiment includes a tray 67 for placing, such as a cover sheet, a sheet printed by a different image forming apparatus, like an inkjet printer. Then, while the sheets are supplied from the photocopier 52, the sheet on the tray 67 is inserted at appropriate timings in a predetermined order. The inserter 54 transfers sheets to the finisher 55.

The finisher 55 serves to carry out post-processing of the transferred sheets. The finisher 55 has various post-processing functions, such as punching, stapling, sorting etc.

The following first explains installation, shifting, connecting method for each device. Then, the printing operation using those devices is explained.

As shown in FIG. 10, the sheet supplying device 59 of the photocopier 52 includes casters 60*a* and 60*b* on the bottom. Further, the sheet supplying device 59 includes a rail joint (rail catch section) 61 to which a rail (rail member) L1 is attached. The rail joint 61 is provided on the bottom of the sheet supplying device 59 on a lower portion than the sheet feeding units 59*a* through 59*d* of the sheet supplying device 59. The rail joint 61 holds the rail L1, however allows it to be pulled out.

Note that, for convenience, FIG. 10 illustrates only the casters 60*a* and 60*b* which are closer to the surface of the plane, and the casters on the other side (ones away from the plane) are not shown. Further, the sheet supplying device 59 may have the height-adjusting leg members, as with the sheet supplying device 8 of First Embodiment above.

The sheet supplying device 59 is movable by the casters 60*a* and 60*b*. Further, the sheet supplying device 59 can be fixed to a certain position by a stopper (not shown) or the like.

As shown in FIG. 10, the sheet feeding device 53 includes casters 62*a* (supporting member, roller member) and 62*b* (auxiliary supporting member, roller member) on the bottom. For convenience, FIG. 10 omits a caster 62*c* provided on the other side of the caster 18*a*.

Here, the casters 62*a* through 62*c* are identical in structure and function to the casters 18*a* through 18*c* of the sheet feeding device 3 of First Embodiment, and therefore the explanation thereof is omitted here.

The sheet feeding device 53 is installed on the photocopier 52 as it is moved by the casters 62*a* through 62*c*. Here, the sheet feeding device 53 is installed by the mechanism having the catch member, adapting part etc. (not shown in the figure) as with the installation of the sheet feeding device 3 to the photocopier 2. The structure having the catch member, the adapting part etc. and the installation operation are the same as those of First Embodiment, and therefore the explanation thereof is omitted here.

Figure 11:
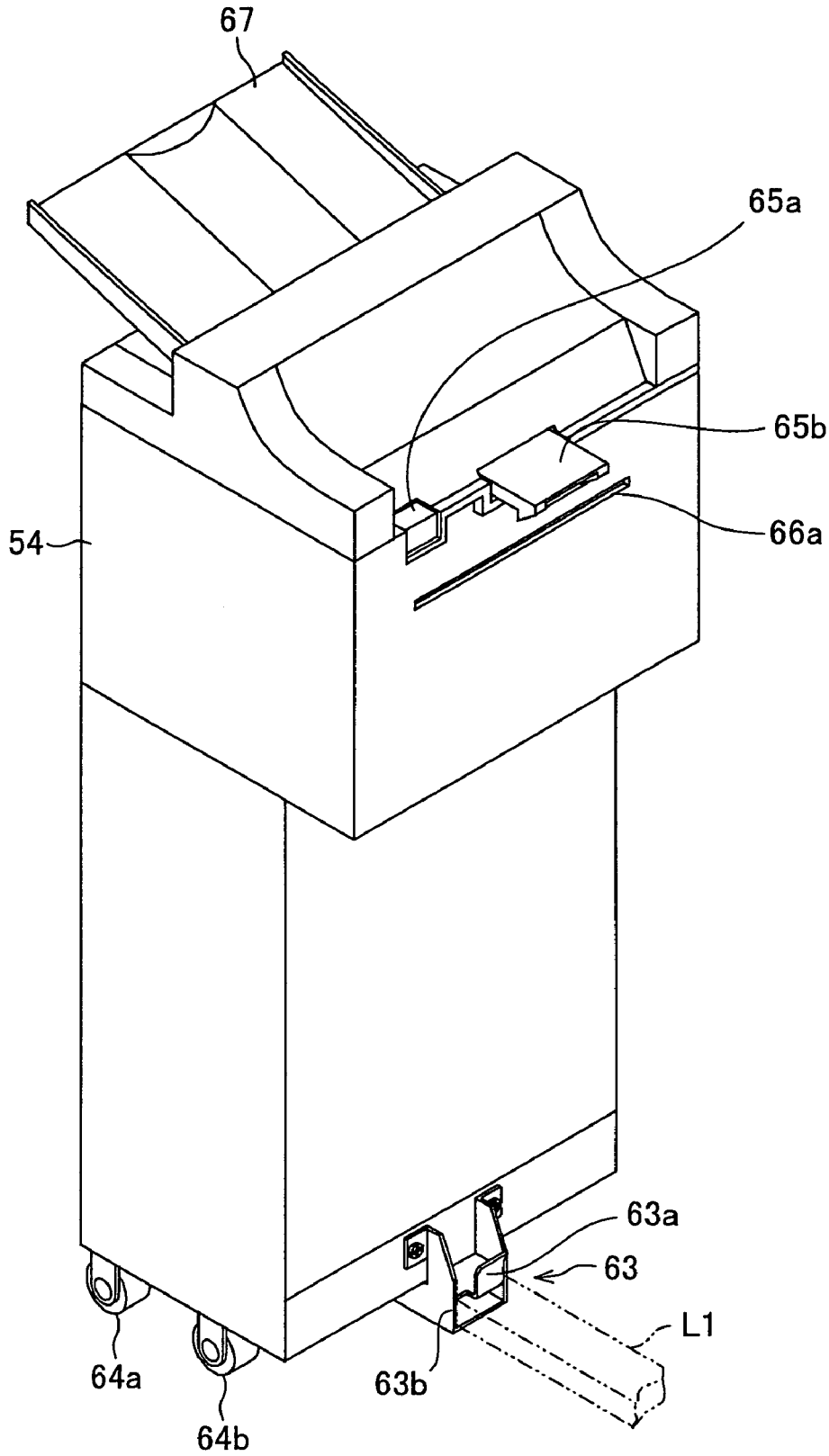
FIG. 11 is a perspective view illustrating an example of peripheral device provided in the foregoing image forming system.

As shown in FIG. 11, the inserter 54 includes a catch section 63. The catch section 63 includes a catch member 63*a* to be operatively connected to an adapting part of other device, and an insertion opening (rail fixing section) 63*b* for inserting and fixing the rail L1.

The rail L1 is held by the rail joint 61, which is provided on a lower portion of the sheet supplying device 59, and can be pulled out by the rail joint 61. The front end of the rail L1 is inserted and fixed into, for example, the insertion opening 63*b* of a periphery device, such as the inserter 54, so that the periphery device is connected to the sheet supplying device 59.

Note that, this connection of the inserter 54 through the catch section 63 is not limited to this structure, that is connection using the rail; for example, the catch section 63 may be operatively connected to an adapting part of other device than the sheet supplying device 59, thus installing the inserter 54 to the other device.

Figure 12:
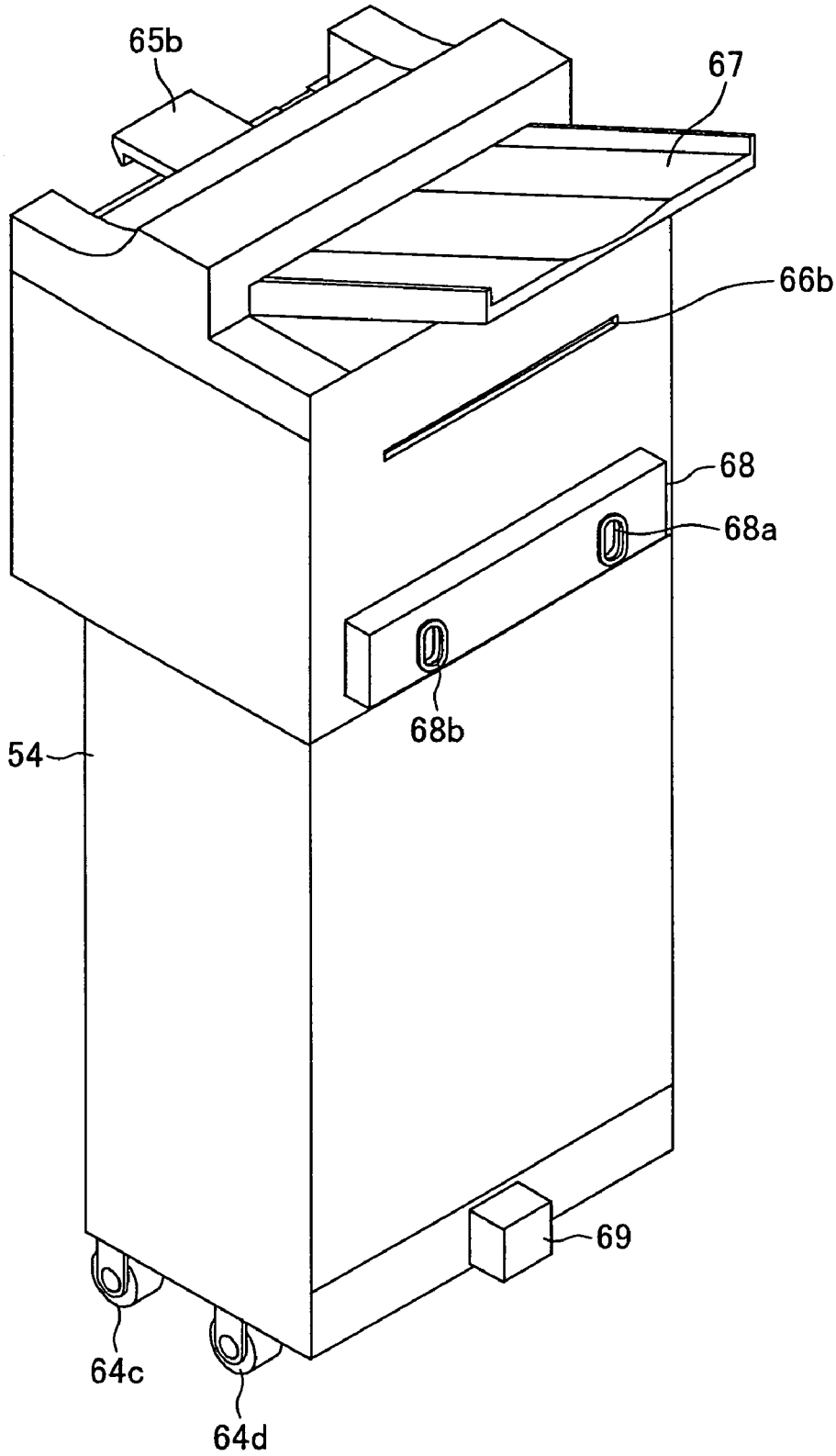
FIG. 12 is another perspective view of the peripheral device of FIG. 11 viewed from a different direction.

The inserter 54 includes casters 64*a* and 64*b* (supporting member, roller member) shown in FIG. 11, as well as the casters 64*c* and 64*d* (supporting member, roller member) as shown in FIG. 12. With these casters, the inserter 54 can be easily moved.

Further, the inserter 54 includes a switch 65*a* and a hook section 65*b* for allowing itself to be engaged or hooked to other device to which the inserter 54 is installed. Further, the inserter 54 includes an insertion opening 66*a* for transferring sheets, and a tray 67 for placing the sheets to be inserted. Further, as shown in FIG. 12, the inserter 54 includes a connection fixing section 68, an adapting part 69, and a discharge opening 66*b*.

The connection fixing section 68 includes lock sections (fitted section) 68*a* and 68*b*. The lock sections 68*a* and 68*b* of the present embodiment are respectively combined with the lock bosses of other device, allowing the inserter 54 to be installed on the device. As described later in detail, the lock sections 68*a* and 68*b* are combined with the lock bosses, which have been inserted into them, and fix the lock bosses therein to complete the installation.

Further, the adapting part 69 served to be combined with a catch section of other device, connecting the inserter 54 into the device.

Note that, the inserter 54 of the present embodiment includes a single catch section 63 and a single adapting part 69; however, the present invention is not limited to this structure. For example, the inserter 54 may include a plurality of catch sections and a plurality of adapting parts. However, when the catch section includes an insertion opening 63*b* for inserting a rail as with the catch section 63 above, the catch section ensures connection/fixation between the respective devices even by only one of them. Further, as described, the insertion opening does not need to be provided in the catch section as with the insertion opening 63*b* of the catch section 63, and the insertion opening and the catch section may be provided separately.

Figure 13:
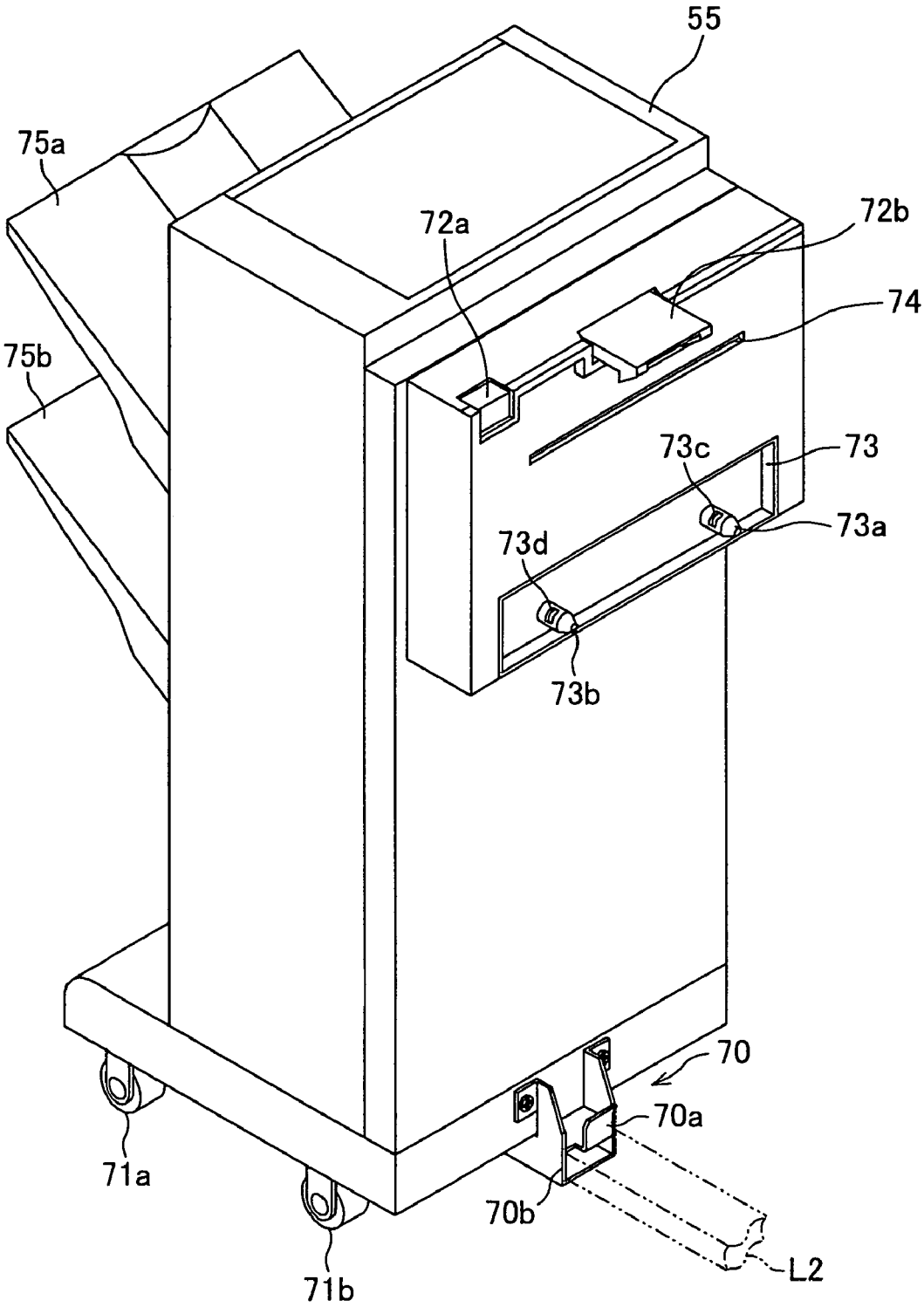
FIG. 13 is a perspective view illustrating another example of peripheral device provided in the foregoing image forming system.

As shown in FIG. 13, the finisher 55 includes a catch section 70 and an attachment frame 73. The catch section 70 includes a catch member 70*a* to be operatively connected to an adapting part of other device and an insertion opening (rail fixing section) 70*b* for inserting and fixing a rail L2 (rail member).

The insertion opening 70*b* allows attachment of the rail L2. The rail L2 is held by the rail joint, which is provided on a lower portion of the device, and can be pulled out by the rail joint. The front end of the rail L2 is inserted and fixed into, for example, a catch section of a periphery device such as the finisher 55, so that the finisher is connected to the device. More specifically, by using the rail inserted to the sheet supplying device 59 as the rail L2, it is possible to directly installing the finisher 55 on the photocopier 52. Note that, when the finisher 55 is directly installed on the photocopier 52, the casters on the bottom of the finisher remain in contact with the floor. Note that, the insertion opening 70*b* does not need to be unified to the catch section 70, and the insertion opening and the catch section may be provided separately.

Figure 14:
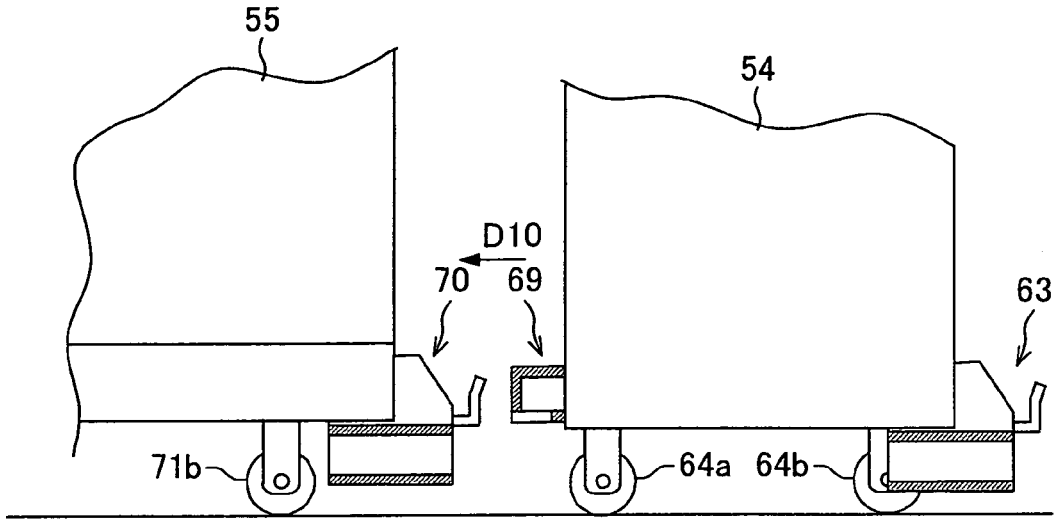
FIG. 14(*a*) is a cross sectional view schematically illustrating the foregoing two different peripheral devices.
Figure 14:
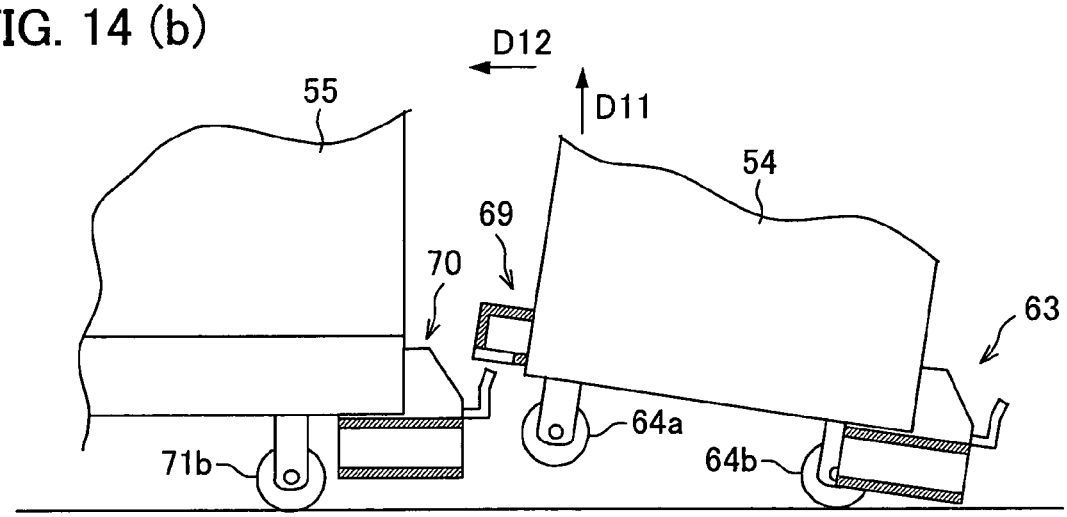
Figure 14:
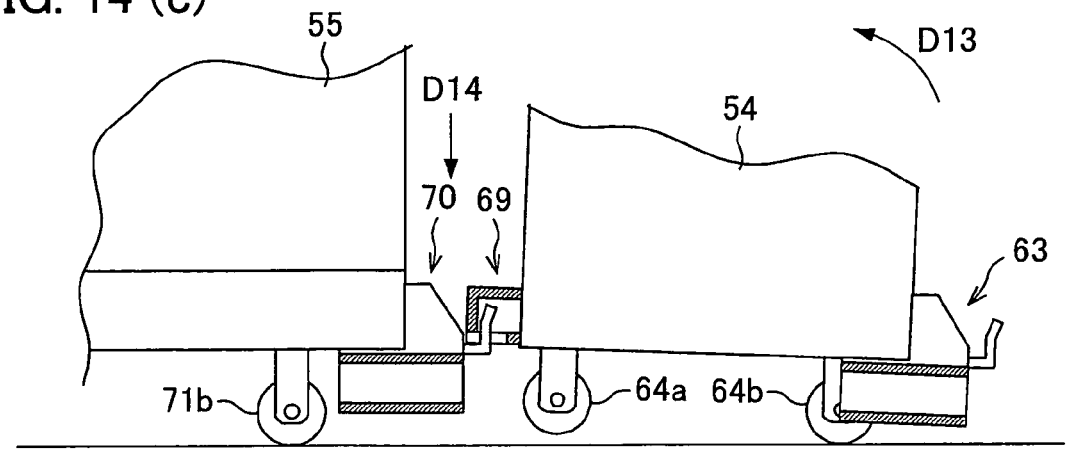

The attachment frame 73 includes lock bosses (fitting section) 73*a* and 73*b*. The lock bosses 73*a* and 73*b* are respectively inserted into the lock sections of the other device, and are fixed thereto. Here, as shown in FIG. 14, the lock boss 73*a* and 73*b* includes lock grooves 73*c* and 73*d*, respectively.

For example, by respectively inserting lock members (not shown) of the lock sections 68*b* and 68*a* into the lock grooves 73*c* and 73*d* as with First Embodiment, the inserter 54 and the finisher 55 can be firmly connected.

Further, the finisher 55 includes a switch 72*a* and a hook section 72*b* for allowing itself to be engaged or hooked to other device to which the finisher 55 is installed. When the finisher 55 and the inserter 54 are connected to each other, the hook section 72*b* is hooked to a hook-catching section (not shown) of the inserter 54, thereby ensuring the connection between the inserter 54 and the finisher 55. Further, when the inserter 54 and the finisher 55 are separated from each other, the hook section 72*b* of the finisher 55 is detached from the hook-catching section (not shown) of the inserter 54 in response to pressing of the switch 72*a*.

Note that, as with the inserter 54 and the finisher 55 of the present embodiment, the connection fixing section 68 may be protruding from a side of the inserter 54, and the attachment frame 73 opposite thereto may be caving in on a side of the finisher 55.

Further, the finisher 55 includes the casters 71*a* and 71*b*. Note that, in FIG. 13, the casters on the rear side of the plane are not shown. The casters 71*a* and 71*b* allow easy movement of the finisher 55.

Further, the finisher 55 includes an insertion opening 74 opposite to the discharge opening 66*b* of the inserter 54; and discharge trays 75*a* and 75*b* through which the sheets are discharged after post-processing.

As described, in the image forming system 51 according to the present embodiment, it is both allowable that only the finisher 55, or both the inserter 54 and the finisher 55 are provided after the photocopier 52 in terms of sheet transfer flow, as shown in FIG. 10. Further, the finisher 55 may be replaced with other periphery device, or plural periphery devices may be provided, for example, a set of the inserter 54, the finisher 55 and some other periphery device(s).

Next, the following minutely explains a method of connecting the photocopier 52, the inserter 54, and the finisher 55. In the present embodiment, the inserter 54 is first installed on the finisher 55, and then the connected inserter 54 and the finisher 55 are further connected to the photocopier 52.

A method of installing the inserter 54 into the finisher 55 is explained below with reference to FIGS. 14(*a*) through 14(*c*). Note that, this installation method is substantially the same as that of the installation method of the sheet feeding device 3 into the photocopier 2 of First Embodiment shown in FIG. 6; it is explained only briefly here.

As shown in FIG. 14(*a*), the inserter 54 is moved by the casters 64*a* and 64*b* toward the finisher 55 in the direction denoted by an arrow D10. Next, as shown in FIG. 14(*b*), the inserter 54 is lifted in the direction denoted by an arrow D11 by using the caster 64*b* or the like as a fulcrum. The lifted inserter 54 is moved to the direction denoted by an arrow D12. Then, as shown in FIG. 14(*c*), the inserter 54 is rotated in the direction denoted by an arrow D13, and the adapting part 69 of the inserter 54 is shifted in the direction denoted by an arrow D14 so as to be operatively connected to the catch section 70 of the finisher 55.

Here, the inserter 54 is further rotated in the D13 direction after the adapting part 69 is connected to the catch section 70, so that the connection fixing section 68 of the inserter 54 is attached to the attachment frame 73 of the finisher 55.

Note that, when the inserter 54 is connected to the finisher 55 in this manner, the casters 64*a* through 64*d* of the inserter 54 are not in contact with the floor on which the finisher 55 is disposed. On this account, the secure connection between the inserter 54 and the finisher 55 is obtained.

Note that, the inserter 54 of the present invention does not include a handle; however, the inserter may have a handle. In this case, the attachment of the inserter 54 becomes easier, as with First Embodiment.

Next, the following explains a structure for installing the inserter 54 and the finisher 55, which are connected to each other, to the sheet supplying device 59 of the photocopier 52.

First, as shown in FIG. 10, the rail L1 is installed on the rail joint 61 of the sheet supplying device 59 of the photocopier 52. Then, as shown in FIG. 11, the inserter 54 and the finisher 55 are moved by the casters 71*a* and 71*b*, and the rail L1 is inserted to the insertion opening 63*b* of the inserter 54.

Since the rail L1 is held by the rail joint 61 so that it can be pulled out by the rail joint 61, the inserter 54 and the finisher 55 may be connected to the photocopier 52 by shifting them toward the photocopier 52 together with the rail L1 inserted to the insertion opening 63*b*, so that they are shifted on the rail L1.

Note that, when the inserter 54 is connected to the photocopier 52, the hook section 65*b* shown in FIG. 11 is hooked to a hook-catching section (not shown) of the photocopier 52, thereby ensuring the connection between the inserter 54 and the photocopier 52. Further, when the inserter 54 and the photocopier 52 are separated from each other, the hook section 65*b* of the photocopier 52 is detached from the hook-catching section (not shown) of the inserter 54 in response to pressing of the switch 65*a*.

Figure 15:
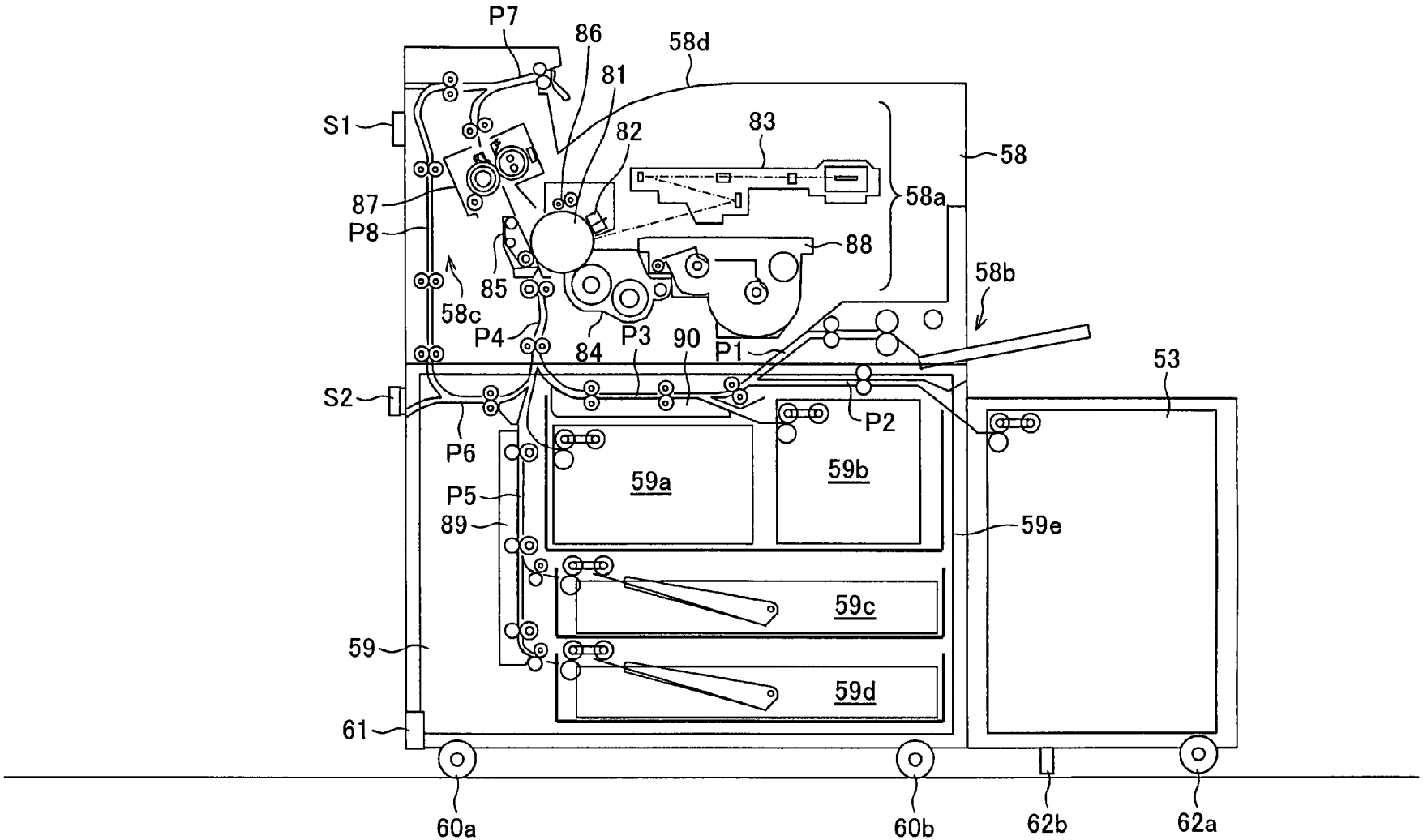
FIG. 15 is a perspective view illustrating a part of the image forming system.

Further, as shown in FIG. 15, the installation condition between the inserter 54 and the photocopier 52 may be checked by a sensor S1 provided on a lateral side of the photocopier 52.

In this manner, detachment/connection of the inserter 54 and the finisher 55 with respect to the photocopier 52 can be easily performed by using the rail L1 as a track. On this account, when the recording sheet transferred from the photocopier 52 is caught or jammed, the inserter 54/finisher 55 can be easily detached/connected, allowing easy recovery. Further, by using the rail L1 as a track, the inserter 54/finisher 55 can be connected to the right position of the photocopier 52.

Note that, the structure of the present invention is not limited to this. For example, those devices may be connected in any arbitrary order according to the structure of the hook section and the catch section in the respective devices, as long as the hook section can be hooked to the catch section.

Next, with reference to FIG. 10, the following explains a structure for printing, and operations for printing and transfer in the image forming system 1 which has been connected and installed in the foregoing manner.

Here, the automatic document transfer device 56 of the photocopier 52 serves to transfer a sheet document (not shown) so as to enable the image scanning device 57 to scan the document. The automatic document transfer device 56 sends the sheets one by one to a scanning region (not shown) of the image scanning device 57.

The image scanning device 57 serves to scan an image of a document placed on a predetermined scanning region. The image scanning device 57 may be operated under an automatic scanning mode in which sheet-type documents with images are supplied one by one by the automatic document transfer device 56, and are sequentially exposed to scan the images. Further, the image scanning device 57 may be operated under a manual scanning mode for scanning a book-type document manually supplied, or any other documents which cannot be supplied by the automatic document transfer device 56.

When the document is scanned, as shown in FIG. 10, the image scanning device 57 exposes the image of the document, which has been transferred to the scanning region of a transparent original platen, using a movable scanning optical system 57*a*, thereby scanning the image. The original platen is provided on an upper portion of the image scanning device 57 to be opposite to the automatic document transfer device 56. The movable scanning optical system 57*b* scans the document by moving under the original platen to the position indicated by the mark 57*d*. Then, the image scanning device 57 forms an image resulting from the scanning on a photoelectric conversion element 57*c*, which is a CCD (Charge Coupled Device), via a mirror unit 57*b*. The photoelectric conversion element 57*c* converts a document image into an electric signal and outputs the signal as image data.

Further, the image scanning device 57 is capable of scanning of both sides of the document. The image scanning device 57 has a function of simultaneous scanning of both sides of document from the bottom and from the top of the document when the automatic document transfer device 56 transfers the document along a document transfer path.

More specifically, in this case, the movable scanning optical system 57*a* sends the optical image to the photoelectric conversion element 57*c* while keeping itself stay still at a predetermined position in the document transfer path, and scans the image on the lower surface of the document. Further, the upper face of the document is scanned by a contact image sensor (CIS: not shown). The contact image sensor is made mainly of a light source (not shown) for exposing the document, an optical lens for leading the optical image to the photoelectric conversion element, and a photoelectric conversion element for converting the optical image into image data, which are unified as a single device. The contact image sensor is provided on the automatic document transfer device 56.

When the two-sides scanning mode is selected, the documents set in a tray (document supplying section) 56*a* of the automatic document transfer device 56 are sequentially transferred via a transfer path 56*b*, and the both sides of the documents are scanned almost simultaneously by the described structure. The transferred documents are discharged to a tray 57*e*, for example.

Further, the image forming section 58 of the photocopier 52 carries out printing of supplied image data, which has been scanned by the image scanning device 57, with respect to the sheets. Note that, the image forming section 58 of the photocopier 52 also carries out printing of image data transmitted from an external device (not shown), such as a personal computer.

Here, with reference to FIG. 15, the following explains a structure of the image forming section 58 and the sheet supplying device 59 of the photocopier 52. For convenience, FIG. 15 illustrates only the image forming section 58 and the sheet supplying device 59 of the photocopier 52, and omits the automatic document transfer device 56 and the image scanning device 57. Further, again for convenience, the inserter 54 and the finisher 55 are also omitted.

As shown in FIG. 15, the image forming section 58 is provided above the sheet supplying device 59.

The image forming section 58 is schematically made up of an electrophotography processing section 58*a*, a sheet supplying section 58*b* and a sheet transfer section 58*c*. The electrophotography processing section 58*a* mainly includes a photoconductive drum 81 and is provided almost in the center of the image forming section 58. Further, the sheet supplying section 58*b* is provided on an external lateral side of the image forming section 58 close to the sheet supplying device 59. Furthermore, the sheet transferring section 58*c* is provided on an internal plane of the image forming section 58, which plane is opposite to the plane on which the sheet supplying section 58*b* is formed.

The electrophotography processing section 58*a* includes the photoconductive drum 81 in its center. The electrophotography processing section 58*a* further includes a charging unit 82, an optical scanning unit 83, a development unit 84, a transcription unit 85 and a cleaning unit 86, which are provided around the photoconductive drum 81.

The charging unit 82 serves to evenly charge the surface of the photoconductive drum 81. Further, the optical scanning unit 83 carries out scanning of optical image on the evenly charged photoconductive drum 81 so as to write an electrostatic latent image on the photoconductive drum 81. The development unit 84 serves to develop the electrostatic latent image, which has been written by the optical scanning unit 83, using a developer.

The transfer unit 85 serves to transcribe the image formed/recorded on the photoconductive drum 81 onto a recording medium (recording sheet). The cleaning unit 86 removes residue developer on the photoconductive drum 81 so that a new image can be formed on the photoconductive drum 81.

Note that, for recycling the residue developer, the developer removed from the photoconductive drum 81 by the cleaning unit 86 is collected to the developer supplying section 88 of the development unit 84. Note that, such a function of recycling the residue developer is not always provided in the image forming apparatus of the present invention; that is, the image forming apparatus may discard the collected toner.

As shown in FIG. 15, the sheet supplying section 58*b* of the present embodiment is used for manual sheet feeding. The sheet supplying section 58*b* transfers the sheets placed on the manual sheet supplying section via a path P1. As it allows easy setting/exchange of sheets, this manual supplying section tends to contain special sheets. However, the structure of the sheet supplying section is not limited to this, and it may include a sheet feeding tray(s).

Further, the photoelectric conversion element 58*c* includes a fixing device 87 for fixing the developer transcribed by the transcription unit 85 into the recording sheet. More specifically, the fixing unit 87 sequentially receives the sheets with transcription images and fixes the developed images having been transcribed on the respective sheets by heat and pressure by using the fixing roller, a pressure roller or the like. In this manner, an image is formed on a sheet.

The sheet supplying device 59 under the image forming section 58 serves to supply a recording sheet to the image forming section 58. As shown in FIG. 15, the sheet supplying device 59 includes the sheet feeding sections 59*a* through 59*d*. The sheet feeding sections 59*a* through 59*d* all contain sheets, respectively. The sheet supplying device 59 is capable of picking sheets one by one in one of the sheet feeding sections 59*a* through 59*d* selected by the user of the photocopier 52 and sends the sheets to the image forming section 58 via a path P5. To realize this function, the image forming section 58 includes a sheet reception entrance for receiving the transferred sheet. Then the sheet is further transferred in a path P4 to an image transcription region where the transcription unit 85 is provided.

Note that, refilling the sheet feeding sections 59*a* through 59*d* with new sheets, or change of sheets stored in the sheet feeding section 59*a* through 59*d* is performed by respectively pulling out the sheet containing sections 59*a* through 59*d* to the lateral side of the main body of the sheet supplying device 59.

Further, receiving the sheets from the sheet supplying section 58*b* of the image forming section 58 through the path P1, the sheet supplying device 59 further transfers the sheets to the path P4 of the image forming section 58 via the path P3.

Further, the sheet supplying device 59 includes a guide 89 in the path P5. When a sheet is jammed in the path P5, the guide 89 is rotated toward the user around the end away from the user, thereby removing the paper caught in the path P5. Note that, this removal operation is performed in a working space previously created between the path P5 and the frame 59*e*.

Further, the sheet supplying device 59 includes a guide 90 in the path P3. When a sheet is jammed in the path P3, the guide 90 is rotated toward the user around the end away from the user, thereby removing the paper caught in the path P3. Note that, this removal operation is performed in a working space under the path P3 which is made by pulling the sheet feeding trays 59*a* and 59*b* toward the user.

Note that, the sheet feeding trays 59*a* and 59*b* can be pulled out simultaneously in the present embodiment; however, the present invention is not limited to this structure, and the sheet feeding trays may be pulled out separately. In this case, this operation for taking out the paper caught in the path P3 is performed in a working space under the path P3, which space is made by pulling the sheet feeding trays 59*a* and 59*b* toward the user.

Further, the photocopier 52 is combined with the sheet feeding device 53. As shown in FIG. 15, the sheet feeding device 53 includes a sheet feeding section for containing a large amount of sheets.

The sheet supplying device 53 supplies sheets in the sheet feeding section one by one into the path P2 of the photocopier 52. The sheets are further transferred to the path P4 of the image forming section 58 through the path P2 and the path P3. Note that, the sheet feeding device 53 may include other sheet feeding section(s).

In this structure, when originals are placed on the tray 56*a* of the automatic document transfer device 56 (one example is shown in FIG. 10), and scanning of the originals is instructed, the automatic document transfer device 56 transfers the originals one by one, allowing the image scanning device 57 to sequentially scan the originals.

The scanned image information is transmitted to a control section (not shown) of the image forming section 58. The control section includes, for example, a circuit board for controlling image forming process, an interface substrate for accepting image data from an external device, or the like. The control section may be provided in a space beneath and/or above the optical scanning unit 83. This space also has other components, such as a power supply device for supplying power to the respective image forming sections.

The control section writes image information scanned by the optical scanning unit 83 into the photoconductive drum 81 in accordance with rotation of the photoconductive drum 81. On the other hand, a recording sheet is transferred to the transcription unit 85 at a certain timing via the path P4, so that an image is formed on the recording sheet.

Here, as shown in FIG. 15, the transfer section 58*c* includes a recording material re-supplying transfer device having a path P8, in addition to the fixing device 87. The recording material re-supplying transfer device is provided on a lateral side of the image forming section 58.

The recording material re-feeding transfer device 9 serves to carry out two-sides printing by reversing the sheet whose one side has already been subjected to printing, so as to carry out printing on the rear side. More specifically, when a sheet whose one side has already been subjected to printing is discharged from the fixing device 87, the recording material re-feeding transfer device leads the sheet to the path P7 according to the switching gate (not shown). Further, the switching gate is switched and the roller is rotated so that the sheet is further carried through the path P6 of the sheet supplying device 59 to be back to the path P4 of the image forming section 58. By thus turning over the sheet, it is possible to print the rear side of the sheet.

Note that, the sheet supplying device 59 may include other periphery device(s) on a different plane from that having the sheet feeding device 53. In this case, the sheet is transferred to outside of the sheet supplying device 59 via the path P6. This discharge of sheet may be detected by a sensor S2 shown in FIG. 15.

Further, the sheet having been subjected to printing in the photocopier 52 may be discharged to the discharge tray 58*d* via the path P7.

Note that, the described structures of the image forming section 58 and the sheet supplying device 59 are only examples, and the present invention may of course use a different printing structure.

The recording sheet discharged from the photocopier 52 passes through the transfer paths (intermediate transfer paths) P9 and P10 of the inserter 54, which are provided in lower stream of the sheet transfer flow, and then reaches the finisher 55.

Here, in the case of including a sheet placed on the tray 67 of the inserter 54 into the group of recording sheets discharged from the photocopier 52, the sheet is transferred from the tray 67 to the path P10 via the path (insertion transfer path) P11.

The inserter 54 has a path (inversion transfer path) P12 in the space beneath the intermediate transfer paths P9 and P10 of the inserter 54. The path P12 is divided by a flapper at a point after the merging point of these insertion transfer paths and the intermediate transfer path, and further extends downstream. Since there is no obstacle in this path, it allows inversion of a long sheet. Further, since the path is covered by the armor of the inserter 54, there will be no defect in inversion. Further, when the sheet gets stuck due to transfer jam or the like in the intermediate transfer paths P9 and P10 or in the inversion transfer path P12, it is possible to handle the jam by opening the amour.

A sheet is inverted by using the path P12 and the path P11. More specifically, for example, by sending a sheet transferred from the path P9 to the path P12, and then sending the sheet to the path P10 using the switch gate, the sheet is inverted. Further, for example, the sheet to be inserted can also be inverted by sending the sheet to the path P11 and the path P12. In this way, the sheet placed on the tray 67 can be included in the group of sheets having been discharged after image forming.

The recording sheet transferred to the finisher 55 is transferred from the path P13 to the path P14, or from the path P13 to P15, according to the user's instruction, and then are set on the discharge trays 75*a* and 75*b*, respectively. Further, depending on the setting, the sheet may be punched, stapled or sorted at predetermined timings.

As described, the present invention relates to an image recording system having a great scalability. In this system, any image recording device with an arbitrary function, such as a photocopier, a printer etc., can be connected to an arbitrary peripheral device. As has been explained, the present invention allows installation of a periphery device to an image forming apparatus without much of labor. Along with this, the present invention provides a particular mechanism of periphery device by which the periphery device (mass recording material supplying device, insertion device, post-processing device) can be easily installed on the main device. Further, it also allows the periphery device to be combined with another periphery device. The present invention also provides a method of connecting devices and an image forming system.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

With the device connecting method of the present invention, it becomes possible to easily connect a plurality of devices. On this account, by employing the present invention to an image forming system capable of mass printing, the system can be easily upgraded.

The invention claimed is:

1. A sheet feeding device including transferring means for transferring sheets from the sheet feeding device to an image forming apparatus on which the sheet feeding device is installed, the sheet feeding device comprising:

an adapting part to be operatively connected to a catch section provided in the image forming apparatus; and a fitted section to be attached to an fitting section provided in the image forming apparatus, the fitted section being attached to the fitting section by moving the sheet feeding device by a fulcrum formed by connection of the adapting part to the catch section, the sheet feeding device being installed on the image forming apparatus by connection of the adapting part and attachment of the fitted section; and a bottom surface of the sheet feeding device being aerially suspended and not in contact with floor when the sheet feeding device is combined with the image forming apparatus.

2. The sheet feeding device as set forth in claim 1, wherein:

the adapting part is protruding from an outer face of the sheet feeding device.

3. The sheet feeding device as set forth in claim 1, further including:

positioning means for determining relative position of the sheet feeding device and the image forming apparatus, the positioning means being provided at a portion close to a sheet discharging section of the transferring means.

4. The sheet feeding device as set forth in claim 1, further including:

a supporting member having a roller member, the supporting member being provided on a bottom of The sheet feeding device on the other side of the adapting part.

5. The sheet feeding device as set forth in claim 4, further including:

an auxiliary supporting member on the bottom of the sheet feeding device, the auxiliary supporting member having a roller member whose axis is substantially orthogonal to an axis of the roller member of The supporting member.

6. The sheet feeding device as set forth in claim 1, further including:

a plurality of handles, provided on at least two sides of The sheet feeding device, at least one of the handles which is closer to an end near the adapting part serves as a lifting handle; and at least two of the handles existing on a same plane as That in which a barycentric vector of the sheet feeding device exists serves as a barycentric handle.

7. An image forming apparatus for carrying out printing on sheets, comprising:

a catch section and an fitting section for installing a detachable sheet feeding device that supplies the sheets, the sheet feeding device being connected to the catch section, the sheet feeding device thus connected to the catch section being shifted to be attached to the fitting section, the sheet feeding device being installed on the image forming apparatus by connection of the catch section and attachment of the fitting section, and a bottom surface of the sheet feeding device being aerially suspended and not in contact with floor when the sheet feeding device is combined with the image forming apparatus.

8. The image forming apparatus as set forth in claim 7, further comprising:

positioning means for determining relative position of the sheet feeding device and the image forming apparatus, the positioning means being provided at a portion close to a sheet feeding entrance through which the sheets are supplied from the sheet feeding device, and being away from the catch section which holds a weight of the sheet feeding device.

9. The image forming apparatus as set forth in claim 8, wherein:

the positioning means determines the relative position of the sheet feeding device and the image forming apparatus in a direction perpendicular to a sheet carriage direction and parallel to the sheets to be transferred.

10. An image forming system comprising an image forming apparatus, and a sheet feeding device for supplying sheets to the image forming apparatus, wherein:

the sheet feeding device comprises: an adapting part to be operatively connected to a catch section provided in the image forming apparatus; a fitted section to be attached to an fitting section provided in the image forming apparatus, the fitted section being attached to the fining section by moving the sheet feeding device by a fulcrum formed by connection of the adapting part to the catch section, the sheet feeding device being installed on the image forming apparatus by connection of the adapting part and attachment of the fitted section, and the image forming apparatus comprises: a catch section and an fitting section for installing a detachable sheet feeding device that supplies the sheets, the sheet feeding device being connected to the catch section, the sheet feeding device thus connected to the catch section being shifted to be attached to the fitting section, the sheet feeding device being installed on the image forming apparatus by connection of the catch section and attachment of the fitting section, and a bottom surface of the sheet feeding device being aerially suspended and not in contact with floor when the sheet feeding device is combined with the image forming apparatus.

11. An installation method of a periphery device on a main device, comprising the steps of:

connecting an adapting part of the periphery device to a catch section of the main device; and attaching a fitted section of the periphery device to an fitting section provided in the main device, the fitted section being attached to the fitting section by moving the periphery device by a fulcrum formed by connection of the adapting part to the catch section, wherein a bottom surface of the periphery device is aerially suspended and not in contact with floor when the periphery device is combined with the main device.

12. An image forming system using a periphery device installation method for installing a periphery device, the installation method comprising the step of:

connecting an adapting part of a periphery device to a catch section of a main device; and attaching a fitted section of the periphery device to an fitting section provided in the main device, the fitted section being attached to the fitting section by moving the periphery device by a fulcrum formed by connection of the adapting part to the catch section, the main device serving as an image forming apparatus which carries out printing on sheets, and the periphery device serving as a sheet feeding device which contains sheets and supplies the sheets to the image forming apparatus, and a bottom surface of the sheet feeding device being aerially suspended and not in contact with floor when the sheet feeding device is combined with the image forming apparatus.

13. An image forming system using a plurality of devices combined one another, comprising:

a first device and a second device connected to each other, the first device comprising a catch section and an fitting section which allow connection of the first device to the second device, the second device comprising an adapting part and a fitted section to be attached to the fitting section of the first device by a fulcrum formed by connection of the adapting part to the catch section, the second device being installed on the first device by connection of the adapting part of the second device to the catch section of the first device and attachment of the fitted section of the second device to the fitting section of the first device; and a bottom surface of the second device being aerially suspended and not in contact with floor when the second device is combined with the first device.

14. The image forming system as set forth in claim 13, wherein:

the second device includes on a bottom a supporting member having a roller member, the supporting member supporting the second device so that the second device is movable by the supporting member, the supporting member of the second device being not in contact with a floor on which the first device is disposed, when the first device is connected to the second device.

15. An image forming system as set forth in claim 13, wherein:

the image forming system includes a main device from which recording sheets are discharged and a plurality of periphery devices from which the recording sheets are supplied, the first and second devices are periphery devices, the main device includes a rail catch section for supporting a rail member, which functions as a track, so that the rail member is movable by the rail catch section, the second device includes a rail fixing section for fixing the rail member, the rail member supported by the rail catch section of the main device is fixed to the rail fixing section of the second device which is connected to the first device, so as to connect the first device and the second device to the main device so that the first device and the second device can be pulled out by the rail member functioning as a track.

16. The image forming system as set forth in claim 15, wherein:

the first device is a first periphery device provided in a downstream portion in terms of a transfer flow of the recording sheets discharged from the main device, and the second device is a second periphery device provided in an upstream portion than the first periphery device in terms of the transfer flow of the recording sheets so that the second periphery device is more closer to the main device than the first periphery device.

17. The image forming system as set forth in claim 16, wherein:

the first device is a post-processing device, and the second device is either an intermediate transfer device or an inserting device.

18. The image forming system as set forth in claim 13, wherein:

the image forming system includes a main device from which recording sheets are discharged and a periphery device from which the recording sheets are supplied, the first device serves as the main device and the second devices serves as a periphery device.

19. The image forming system as set forth in claim 18, wherein:

the first device is an image forming apparatus and the second device is a sheet feeding device.

20. A device connecting method for connecting a plurality of devices, the method connecting a first device and a second device with the steps of:

connecting an adapting part of the second device to a catch section of the first device; and attaching a fitted section of the second device to an fitting section of the first device by shifting the second device by a fulcrum formed by connection of the adapting part to the catch section, and a bottom surface of the second device being aerially suspended and not in contact with floor when the second device is combined with the first device.

21. The sheet feeding device as set forth in claim 1, further including:

a roller member located on side of bottom side of the sheet feeding device furthest away from the adapting part for attaching the adapting part to the catch section by moving the sheet feeding device by a fulcrum formed by the roller member located on the side of the bottom side of the sheet feeding device.

* * * * *

UNITED STATES PATENT AND TRADEMARK OFFICE

CERTIFICATE OF CORRECTION

PATENT NO. : 7,431,287 B2
APPLICATION NO. : 10/558413
DATED : October 7, 2008
INVENTOR(S) : Shigeki Hayashi et al.

It is certified that error appears in the above-identified patent and that said Letters Patent is hereby corrected as shown below:

IN THE SPECIFICATION:

Title page Item [54], in the title, change "SHEET FEEDING DEVICE, IMAGE-FORMING DEVICE, IMAGE-FORMING SYSTEM, METHOD OF INSTALLING PERIPHERAL DEVICE, AND METHOD OF CONNECTING DEVICES" to --SHEET FEEDING DEVICE, IMAGE FORMING APPARATUS, IMAGE FORMING SYSTEM, METHOD OF INSTALLING PERIPHERAL DEVICE, AND METHOD OF CONNECTING DEVICES--

Signed and Sealed this

Tenth Day of March, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,431,287 B2
APPLICATION NO. : 10/558413
DATED : October 7, 2008
INVENTOR(S) : Shigeki Hayashi et al.

It is certified that error appears in the above-identified patent and that said Letters Patent is hereby corrected as shown below:

Title page Item [54] and Column 1, lines 1-5, in the title, change "SHEET FEEDING DEVICE, IMAGE-FORMING DEVICE, IMAGE-FORMING SYSTEM, METHOD OF INSTALLING PERIPHERAL DEVICE, AND METHOD OF CONNECTING DEVICES" to --SHEET FEEDING DEVICE, IMAGE FORMING APPARATUS, IMAGE FORMING SYSTEM, METHOD OF INSTALLING PERIPHERAL DEVICE, AND METHOD OF CONNECTING DEVICES--

This certificate supersedes the Certificate of Correction issued March 10, 2009.

Signed and Sealed this

Thirty-first Day of March, 2009

John Doll

JOHN DOLL
*Acting Director of the United States Patent and Trademark Office*